US005277785A

United States Patent [19]

Van Anglen

[11] Patent Number: 5,277,785

[45] Date of Patent: Jan. 11, 1994

[54] METHOD AND APPARATUS FOR DEPOSITING HARD CHROME COATINGS BY BRUSH PLATING

[76] Inventor: Erik S. Van Anglen, No. 1 Stonegate Rd., Quakertown, Pa. 18951

[21] Appl. No.: 915,455

[22] Filed: Jul. 16, 1992

[51] Int. Cl.[5] ..... C25D 5/06

[52] U.S. Cl. ..... 205/117

[58] Field of Search ..... 205/117

[56] References Cited

U.S. PATENT DOCUMENTS

| | | | |
|---|---|---|---|
| 2,693,444 | 11/1954 | Suavely et al. | 205/243 |
| 3,001,925 | 9/1961 | Berry | 204/224 R |
| 3,183,176 | 5/1965 | Schwartz | 204/212 |
| 3,339,134 | 7/1968 | Schwartz | 205/115 |
| 3,751,343 | 8/1973 | Macula et al. | 205/118 |
| 4,269,686 | 5/1981 | Newman et al. | 204/212 |
| 4,359,366 | 11/1982 | Eidschun | 205/125 |
| 4,452,684 | 6/1984 | Palnik | 204/206 |
| 4,610,772 | 9/1986 | Palnik | 204/206 |
| 4,738,756 | 4/1988 | Macitif | 205/102 |
| 4,750,981 | 6/1988 | Dalland et al. | 204/224 R |
| 5,853,099 | 8/1989 | Smith | 204/224 R |

*Primary Examiner*—T. M. Tufariello

*Attorney, Agent, or Firm*—O'Keefe & Wilkinson

[57] ABSTRACT

Thick layers of hard dense chromium coatings are formed on metal substrates by an electrolytic brush plating operation in which a lead-tin electrode having a porous polypropylene felt topped by an polypropylene molded brush element is maintained during coating continuously over the area to be electrolytically coated. The correct current density and flow of electrolytic coating solution as well as relative movement between the anode and brush element and the work piece are closely controlled to enable the hard chromium coating to be produced.

8 Claims, 6 Drawing Sheets

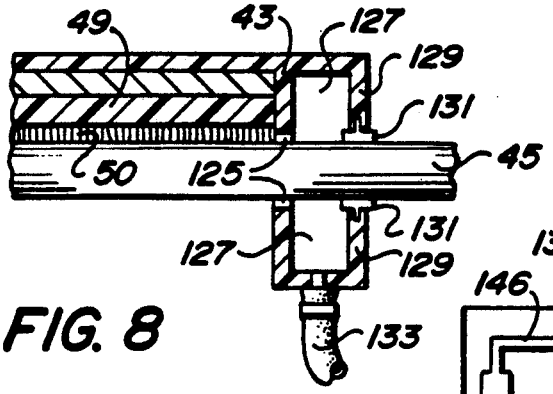
FIG. 8
FIG. 9
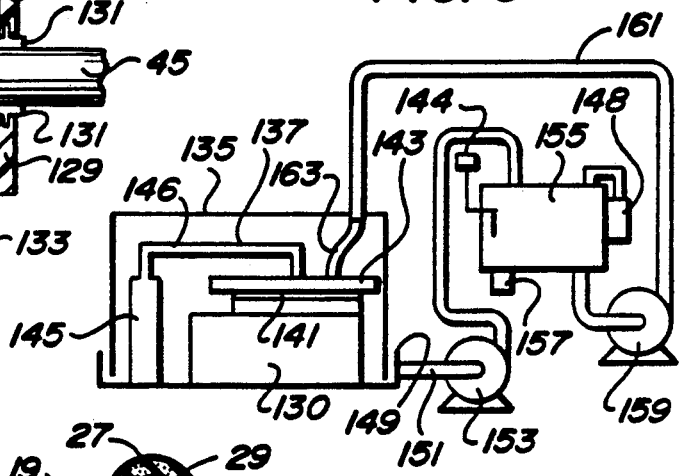
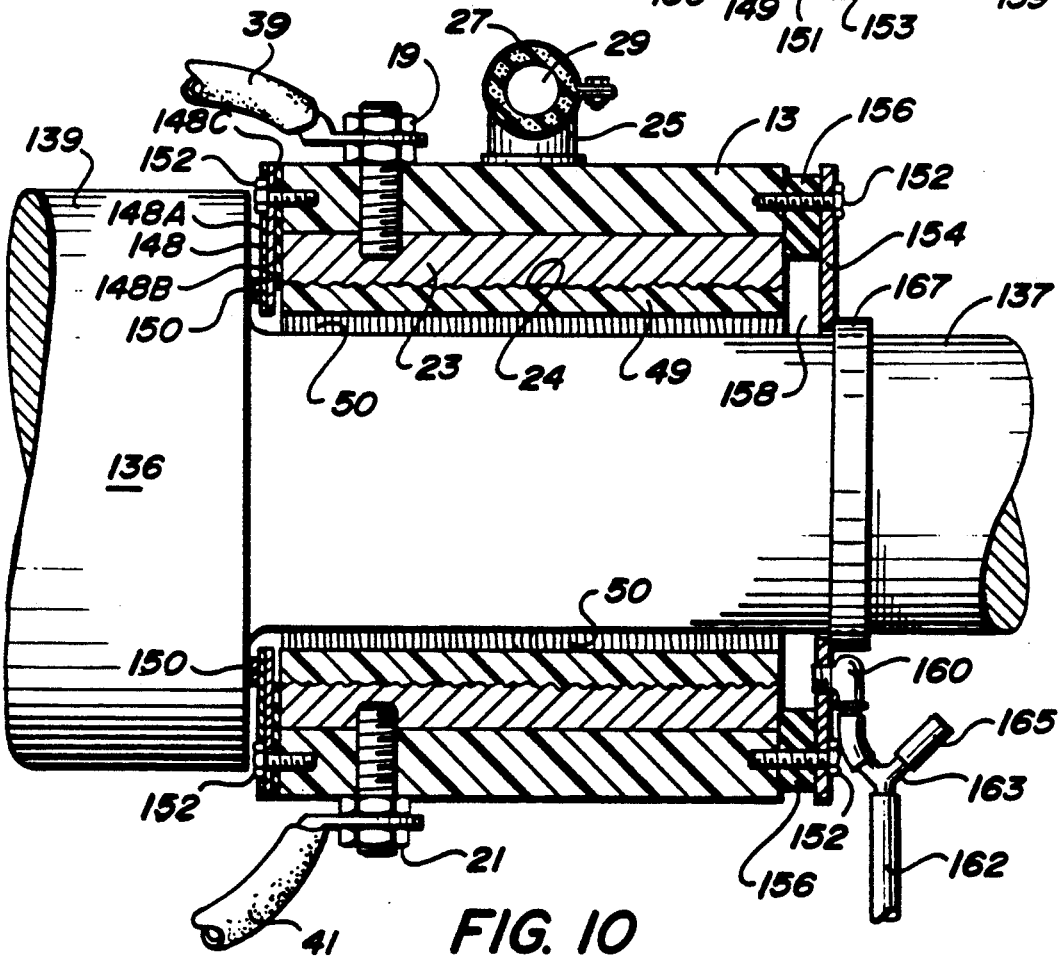
FIG. 10

METHOD AND APPARATUS FOR DEPOSITING HARD CHROME COATINGS BY BRUSH PLATING

BACKGROUND OF THE INVENTION (1) Field of the Invention

This invention relates to the deposition of hard chrome coatings from plating solutions. More particularly, this invention relates to the deposition of hard chrome coatings by means of brush plating.

(2) Prior Art

A number of coatings are deposited from so-called plating baths in which a coating solution is subjected to an imposed electrical potential. Such imposed electrical potential basically enhances an already naturally occurring tendency for any metal ions in a solution to be deposited, or plated out of solution, upon any metal object or surface immersed within or partially within the solution. Such metal surfaces are, under favorable conditions, able to supply electrons to metallic ions dissolved in the solution converting such ions to less soluble metallic atoms which are deposited upon the electron donor material. This natural deposition, or plating out, of the coating material from a natural solution may be rather slow or in many cases even more than counterbalanced by simultaneously proceeding resolution processes. However, the natural deposition or plating rate can be improved dramatically by application of an external electrical potential to a plating bath, in effect causing a current to flow through the bath, such current serving to rapidly convert dissolved metal ions to metal atoms which deposit or plate out as a coating on the cathode from which electrons are derived. Such externally applied current also more quickly forms metallic ions at the anode when appropriate which ions dissolve within the solution of the coating bath to take the place of those deposited or plated out upon the cathode or other adjacent materials. So-called "electrolytic coating" using electrolytic coating baths is very widely used, both on a small scale and very large scale for production-type coating facilities.

While conventional coating baths are effective and efficient means for the coating of metal bases such as iron and steel and the like, the large tanks of solution necessary to effect a normal coating from an electrolytic coating bath make the process practical only for fairly large permanent installations. There is frequently a necessity, however, to conduct plating operations in emergency or job shop-type situations, on relatively small pieces or sections or single items or objects of metal, or upon items in the form frequently of single broken or worn metal apparatus which needs to be refurbished by replating or the like. Emergency repairs, for example may be conducted on shipboard or other places where the provision of a full-scale or even a relatively small scale plating bath is either impossible or at best impractical.

So-called brush plating is an alternative to tank plating, and in some cases, a preferred method of plating. This process, which is generally known as brush plating in the trade at large, is also known by a number of other names, and particularly by plating experts as "selective plating", not to be confused with "selective plating" accomplished in a tank, frequently on copper-based alloy contacts and usually also with gold plating. Selective plating in a plating tank environment is usually accomplished by thoroughly masking all parts not to be plated. Selective or brush plating is generally a more convenient, although to some extent more difficult, process to effectively use than tank plating. There have been a number of recent additional names suggested for brush plating. Among such names are "stylus plating", "contact plating", electrochemical metalizing", as well as "selective electrochemical metal deposition", sometimes known by the acronym "SEMD". The common name among plating experts, however, as pointed out above, is "selective plating". The term brush plating, used commonly in plating shops, is descriptive, since the basic principal of the technique is to continuously agitate or abrade the surface being plated to remove bubbles of hydrogen which bubbles may otherwise collect upon the surface and interfere with the efficiency of the plating. The term brush plating will consequently be used in this description.

Brush plating has a number of advantages over tank plating, of which the following may be particularly mentioned: (a) first and most important, is the ability of brush plating to deposit an electroplated metal precisely onto the portion of the surface of a base metal where it is desired in almost any thickness which is desired. In fact, this is the origination of the name "selective plating"; (b) secondly, in some cases brush plating or selective plating can provide superior coating at a cheaper price;. (c) thirdly, brush plating or selective plating can be used in environments where normal vat or tank plating will not be available, for example, at the location where a repair must actually be made, for example, on shipboard and in other locations where a substantial vat of coating solution would not be available.

Brush plating, or selective plating, has become particularly popular for repairing previously coated surfaces where only a portion of such surface has been seriously worn or is otherwise damaged such as, for example, on rotatable shafts and the like where continuous movement of the shafts may have worn through a previous coating in a particular portion or otherwise seriously eroded the surface. For the same reason, brush plating, or selective plating, can often be used to fill in a discontinuity which has developed in the surface of another metal piece even where such original piece was not coated. Again, therefore, brush plating or selective plating is particularly valuable in repairing or refurbishing worn materials such as shafts and the like which are subject to severe localized wear due often to breakdown in their normal lubrication or to an unequal or unbalanced operation or the like.

Brush plating, or selective plating, can be accomplished either by sophisticated apparatus made especially for such plating or can be a hand operation using only very basic apparatus, the movement of the "brush" portion of which is accomplished manually. Basically, in the usual process, a graphite or sometimes platinum anode, which may be either mechanically supported and actuated or hand held and which is designed to conform to the shape of the work piece which is to be repaired or coated, is held or supported close to the surface of such work piece while a current is passed through a plating solution continuously between the anode and the surface to be repaired or otherwise treated. The anode is maintained positive and the work piece is given a negative charge via a suitable negative contact which converts the work piece into the cathode. When the anode and work piece are brought close together with appropriate plating solution between the two and with current passing from the cathode to the anode via the metallic ions of the bath, metal ions from the plating solution are deposited upon the work piece opposite the anode, or those portions of the anode which most closely approach the surface of the work piece. This enables the size and shape of the anode to determine the size and shape of the area to be coated. The anode must never touch the surface of the work piece else all the electric charge would arc between the anode and cathodic work piece melting any coating already plated out and usually damaging not only the work piece itself, but also quite likely the anode as well.

Since it is difficult to merely pass or flow plating solution between an anode and a work piece without the area in question being surrounded by a container of some sort, the anode is usually provided with an absorbent material upon its surface which will temporarily retain the plating solution. The absorbent material is held close to the surface of the work piece to maintain the work piece continuously subject to or bathed within the plating solution absorbed in or saturating such absorbent material.

The absorbent material should be formed from a dielectric material to prevent arcing between the anode and cathode. Some form of special abrasive or rubbing material is also frequently affixed to the face of the anode or to the absorbent material to rub on the surface of the work piece in the area to be plated as the anode passes over it. Such abrading or rubbing serves to displace the bubbles that normally form on the surface of the work piece in any plating operation, which bubbles may partially shield the work piece surface from the plating solution, thus interfering with the plating operation. Rapid removal of such bubbles, usually comprising hydrogen, enables a more rapid, uniform and effective plating to be accomplished. If a special rubbing or brushing material is not used, the surface to be plated is rubbed with the surface of the absorbent material which serves to remove the hydrogen bubbles formed upon the surface as plating proceeds.

In order to continuously abrade or brush the surface of the work piece during the coating operation, either the graphite anode or the cathodic work piece is maintained in substantially constant motion. Where a round section such as a shaft is being coated, it is usually most convenient to rotate such shaft with respect to the anode, while for other shaped pieces and particularly the usual flat work surface, it is usually found more convenient to move the anode continuously during the brush plating process. The brush-plating process is frequently used to restore both the outside diameter and the inside diameter of cylindrical objects as well as the configuration of plane surfaces of many parts such as, for example, shafts, bearings, hollow members, journals and other work pieces, to an original dimension or to provide specific surface conditions, usually wear-resistant surfaces. The brush coating process is also often used for the filling of corrosion pits and the like in metal surfaces and in providing hard facing and the like upon metal surfaces.

In general, brush plating, or selective plating, coatings are usually more dense and fine grained as well as less porous than similar coatings applied by other types of electroplating processes. It has been said that brush plated coatings are, in general, seventy-five percent less porous than deposits formed by tank plating and ninety-five percent less porous than deposits applied by metal powder or wire spray-type coating processes. Because of such additional denseness, the deposits frequently offer greater corrosion resistance as well as hardness. The final results, however, depend largely upon the metals used as coating materials and the coating process.

Brush or selective plating usually provides, as indicated briefly above, much harder as well as denser deposits than those obtained by other types of electroplating so that brush-plated work pieces are usually more abrasion resistant and less susceptible to fatigue loss during use.

Superior adhesion of the coating material is often also attained by a properly operated brush or selective plating process. This is believed to result, however, more from the fact that an organic plating solution is usually used in a brush-plating operation, whereas an inorganic solution is frequently used in tank plating and other general electroplating operations. Organic plating solutions generally have a higher conductivity than inorganic solutions and therefore the work piece is customarily subjected to a far greater current density, often in the range of 1000 to 3000 amps per square foot rather than the 100 to 500 amps per square foot which is more customary in tank plating arrangements. Such high current density is almost equivalent to an arc welding process and the metal ions therefore seem to be driven more forcefully into microscopic valleys and cracks upon the surface structure of the base metal, locking them more effectively into place. In conventional tank plating, on the other hand, the plated coating often seems to merely plate over valleys, cracks and other inequities in the surface of the work piece. The close spacing between the anode and the cathodic work piece and the fact that the charge on the anode is not dissipated by dissolution or dissolving of anode material into the plating bath to replenish the metal ion content of the bath also probably has considerable to do with the more intimate coating produced.

Many metals can be successfully brush plated, including cadmium, cobalt, copper (both from acidic and alkaline solutions), gold, nickel (both from acidic and neutral plating solutions), rhodium, silver and tin. One notable and well-known failure of brush plating, however, has been the inability to provide a hard chrome deposit by brush plating even though brush plated deposits are usually more dense than equivalent tank plated coatings. While extremely thin hard chrome coatings have been sometimes attainable and generally thin, relatively soft deposits of chrome could be attained heretofore using brush plating techniques, thicker hard chrome deposits were completely unattainable. As may be imagined, this lack of ability to form hard chrome coatings has been a serious drawback since hard chrome deposits are, in general, superior to any other electroplated surface for wear resistance, low coefficient of friction, hardness, heat resistance and non-galling characteristics. In view of this, sometimes nickel has been plated in place of chrome and a nickel tungsten or nickel cobalt alloy has also sometimes been used in place of a hard chrome plating to take advantage of the preciseness, affordability and other conveniences of the brush-plating process.

A number of efforts have been made to successfully deposit hard chrome coatings or thicker hard chrome coating using the brush-plating process. However, to date, no successful process or apparatus for plating with hard chrome has, so far as the present inventor is aware, been developed. Furthermore, no adequate theory to explain the inability to provide hard chrome coatings by brush plating has been advanced. While very thin hard chrome coatings have been made, it has been impossible to provide useful thicker hard coatings. There has been a need, therefore, for a brush-plating process which can successfully provide a hard chrome surface coating of reasonable thickness. Some of the more pertinent prior art patents related to the problem of brush plating of hard chrome coated surfaces or having disclosures showing the state of the art or otherwise of interest in this regard are as follows.

U.S. Pat. No. 3,751,343 issued Aug. 7, 1973 to A. J. Macula et al. discloses a hand tool for brush coating metal surfaces with an increased rate of deposition. Macula et al. discloses that brush coating apparatus at the time of the filing of his application was usually in the form of a hand tool which was rubbed or brushed against the surface to be plated as electrolytic action took place. The hand tool which served as the anode of the coating operation was wrapped in a porous or dielectric fabric sock saturated with the coating solution or electrolyte and rubbed over the surface during the process of coating. Macula felt that the inability of the brush-coating process known in his time to operate at high current densities limited the rates of metal deposition and his solution was to initiate movement of the porous sock with respect to both the cathodic work piece as previously practiced, but also with respect to the anode at the same time. Macula's improvement, therefore, was to provide a combined rubbing action on both the anode and the cathodic work piece at the same time. Such rubbing, he believed, removed unwanted products of electrolysis as well as avoided passivation and polarization of the anode and cathode as well as the usual physical removing of gases and unwanted precipitates from the surface to be plated. The porous electrolyte-saturated sock of Macula could be made of various fabrics, for example, cotton, flannel, felt, canvas, but was preferably made of resinous materials such as dacron-polyester fibers, which he used especially for chromium plating, since such materials, according to Macula, had good resistance to attack by chromic acid. So far as is known, the Macula process was not effective for forming hard chrome coatings.

U.S. Pat. No. 3,001,925 issued Sep. 26, 1961 to E. V. Berry discloses an anode structure for an electrolytic coating bath for coating sections of a crank shaft which may be rotated within the coating bath. The arrangement, which is a more or less conventional coating bath and not a brush plating arrangement, is said to provide rapid deposition of hard chromium coatings. Berry makes use of a lead anode which at least in part closely surrounds the portions of the work piece to be chromium coated. Such anodes are made either of a lead-antimony or an alloy of lead and tin and are curved so they pass partially about the surface of the portion of the crank shaft to be coated, but preferably not completely about it, leaving open either a lower or top portion. The lead anode itself is contained within a holder which shields it from contaminants in the bath. The surface of the anode is preferably grooved or ridged in order to provide an increased ratio of anode-to-cathode surface which Berry states has been found to decrease the formation of trivalent chromium in the chromic-acid bath. Berry goes on to indicate that an increase in trivalent chromium in a chromic-acid plating bath is highly undesirable because it increases the electrical resistance of the bath which is also increased with an increase in temperature of the bath. Berry also discloses that after prolonged use, the surfaces of the lead anodes become covered with oxide and chromate coatings which are relatively poor conductors of electrical energy and therefore form insulators over the surface causing an undesirable rise in the temperature of the bath. Berry tries to arrange for an evolution of oxygen bubbles for continuous removal of hydrogen gas from the various surfaces, but apparently was not particularly successful in this endeavor. It should be emphasized that the Berry patent is directed specifically to tank plating and not to brush plating and generally illustrates, as an example, the only viable practical type of arrangement for plating hard chrome coatings upon work pieces available in the past.

U.S. Pat. No. 4,269,686 issued May 26, 1981 to A. W. Newman et al. also discloses an apparatus for electroplating the bearing surfaces of a crank shaft within a plating bath as distinguished from brush coating. The plating bath of Newman is a chromic-acid bath for plating chromium on the bearing surfaces. Newman discloses an arrangement for his anodes to closely encompass the surfaces of the crank shaft to be plated without touching such surfaces and discloses that such anodes should be formed from a lead composition.

As indicated, the Newman patent is directed to tank coating or plating and does not provide any way to brush plate chromium. Newman, consequently, has the disadvantages of tank plating, particularly its lack of ready portability and inconvenience in the repair of limited portions of defective work pieces.

U.S. Pat. No. 4,359,366 issued Nov. 16, 1982 to C. D. Eidschun discloses an arrangement for brush plating printed circuit boards in an electrolytic plating bath. The use of natural polypropylene is disclosed within the anode chamber. While the Eidshun patent is essentially a brush-plating procedure, the brush used is a stainless steel conductive brush. The patent is limited basically to salvaging misplated circuit boards and would appear to have little other application.

U.S. Pat. No. 4,452,684 issued Jun. 5, 1984 to K. Palnik discloses a brush or selective plating apparatus said to accomplish high speed selective plating by the brush method using a brush comprised of a molded body formed with a porous, hydrophobic material covered by a felt-like material. A porous platinum sheet or screen is positioned between the two to serve as the anode. The electrolytic solution is distributed through a conduit located interiorly of the brush and passes outwardly through small pores in the hydrophobic material till it covers the felt-like material. A suitable porous hydrophobic material is disclosed by Palnik to be preferably a molded polypropylene having pores uniformly dispersed throughout so that it is pervious to liquids. Palnik states as a generalization that larger pores and greater pore density will permit faster plating rates but may result in more plating solution being deposited on the surface of the material to be plated than necessary, making selective plating more difficult to control. In the arrangement of Palnik, the parts to be coated are passed by the stationary brush material in contact therewith only once rather than being subjected to multiple passes or a back-and-forth rubbing or abrasion. Palnik's arrangement is designed to be used only for the plating of gold and other precious metals on electrical contact apparatus and the like. Recirculation of plating solution and replenishment of spent solution prior to or during recirculation is broadly disclosed, but not detailed.

U.S. Pat. No. 4,610,772 issued Sep. 9, 1986 to K. Palnik also discloses the use of a porous hydrophobic material having interconnected pores made from molded porous polypropylene as disclosed in Palnik's earlier patent. In the '772 patent, however, Palnik provides for the use of a rotating rather than a stationary brush. Palnik prefers in both cases to use a porous polypropylene brush material having pore sizes in the range of 100 to 200 micro-inches in diameter to attain "excellent results". He also discloses that "if desired, a soft, porous, absorbent cover may be provided on the porous body member". FIG. 5 of Palnik appears to show such porous body member 36 with a porous absorbent cover 37. Again the plating material is gold and other precious metals which are plated upon continuous strips of copper-based alloy used for electrical contacts.

U.S. Pat. No. 4,750,981 issued Jun. 14, 1988 to H. W. Dalland et al. discloses an electroplating method which is not a brush or selective coating method, but is a method for coating discrete surfaces of physical bodies, particularly bodies having orifices in them wherein a portable chamber is provided for clamping onto the surface of the work piece at the point where the coating is to be provided, said chamber having within it an anode which is located closely adjacent to, but electrically isolated from the surface to be coated. It is said that the anode is typically a carbon anode or else an anode made of the metal which is to be coated upon another metal. A preferred embodiment of Dalland et al. shows a pair of containers each positioned over the end of an orifice, the interior surface of which is to be plated. Dalland states that his invention or apparatus is designed to be used where neither tank plating nor brush plating are practical. He further discloses that "brush coating is not suitable for applying certain desired chrome platings that, heretofore, have required dip tank-type solutions".

U.S. Pat. No. 4,853,099 issued Aug. 1, 1989 to G. W. Smith discloses an electroplating apparatus for rapidly electroplating a surface of a work piece by a so-called gap-type electroplating which is not brush or selective plating. Smith provides an anode in a shape and having a surface generally matching the shape and selective surface of the work piece being plated and provides a current flow between the anode and cathode established by the geometry of the anode surface as it relates to the work piece being plated. While gap plating can be accomplished in a tank and is often done in a plating tank, it is stated that it can also be accomplished by directing a plating solution into the gap between the anode and cathode as a current is applied between such two electrodes as long as a closed fluid flow can be maintained through the gap. The contribution of the Smith patent to the art of gap coating is to form a very narrow gap and then pump a large amount of plating solution to it so that the plating solution passes very quickly. It is stated that these ultra high flow rates allow high current densities which in turn cause rapid deposition of metal from the flowing plating solution. The preferred element for use in the gap coating process is, according to Smith, nickel. Smith discloses that chromium plating is not very effective in his apparatus because the increase of density of current does not increase the plating of the chrome. He therefore prefers to coat with nickel, which will deposit at a rate that increases substantially with increased current density. However, Smith does state in column 11, lines 24 through 26 that some of the features of his invention may also assist in providing some benefit for a chromium plating system. It appears from Smith's discussion that the reason for the effectiveness of his process may be because overheating of the electrolytic solution is prevented by passing the solution very quickly through the plating area at a high flow rate. Smith also discloses that this ultra high flow of the electrolytic solution assures the removal of gas bubbles, the maintenance of low temperature and the high solution pressure contact with the anode surface and the work piece surface which he believes increases the efficiency of his system. He discloses a work opening usually of between 0.05 inches and 1 inch, but apparently prefers the narrower gaps in order to provide a higher flow.

As will be evident from the discussion above, it has not been possible previously to provide successful hard chromium coatings by the brush plating method and as a result, the preciseness of coating, the convenience of coating at the work site as well as the portability of the necessary apparatus and the other advantages of brush or selective coating have not been available for the provision of hard chrome coatings, yet hard chrome coatings are one of the prime metallic coatings for the repair particularly of the bearings for shafts, shaft surfaces and the like. There has been a critical and long continuing need, therefore, to have a brush plating-type apparatus and procedure for plating with hard chromium.

OBJECTS OF THE INVENTION

It is an object of the invention, therefore, to provide a brush-coating process whereby hard chromium coatings can be successfully brush coated upon various work pieces.

It is a further object of the invention to provide an apparatus in which successful brush coating of hard chrome wear surfaces and the like can be made on various work pieces.

It is a still further object of the invention to provide an apparatus for hard chrome coating by the brush plating method, including the use of a lead anode having a surface which is continuously maintained adjacent to the area of the work piece which is to be coated and having an arrangement for passing the coating solution rapidly through the coating area while continuously rubbing or abrading such area.

It is a still further object of the invention to provide a brush coating apparatus in which the process is environmentally unobjectionable.

It is a still further object of the invention to provide a brush coating process for the coating of hard chromium coatings on work pieces in which the rate of flow of the plating solution, the current density and the anode gap is such as to provide an effective coating.

It is a still further object of the invention to provide a hard chrome surface of a reasonable thickness by a brush or selective coating process to take advantage of the superior wear resistance, low coefficient of friction, hardness, heat resistance and non-galling characteristics of a hard chrome coating.

It is a still further object of the invention to provide a hard chrome surface of a reasonable thickness by a brush-coating process to take advantage of the portability, convenience, accuracy and quickness of plating conferred by brush plating.

It is a still further object of the invention to provide an apparatus for forming a hard chrome coating on a work piece by the use of an apparatus including a pre-electrolized surface lead anode arranged for continuous effective contact of the anode with all surfaces of the work piece to be coated by maintaining the anode continuously opposite the work piece surfaces to be coated.

It is a still further object of the invention to provide a method of operating a hard chrome coating operation in a constant manner or mode by which it will be enabled to continue hard chrome coating for an effective period to provide a significant chrome deposit.

It is a still further object of the invention to provide a method and apparatus for brush coating of significant deposits of hard chrome on metal surfaces in which at least a portion of the brush plating anode is maintained at all times at an effective coating deposition distance from every portion of the area to be coated while being continuously moved with respect to such surface, whereby an effective coating rate is continuously maintained upon the surface and heavy coatings of hard chrome are attained or deposited.

Other objects and advantages of the invention will become apparent from a careful review of the following description and explanation in conjunction with the attached drawings.

BRIEF DESCRIPTION OF THE INVENTION

The present inventor has discovered that hard chrome coatings can be formed upon work pieces by use of a brush-plating-type process including the use of a preferred apparatus, including or incorporating a lead anode, and preferably a lead tin anode, having a surface closely configured to the surface of the work piece and provided with an arrangement by which the anode is continuously moved with respect to the surface of the work piece and wherein the anode continuously covers or is at all times immediately adjacent to the section of the work piece which is to be coated with the surface being rubbed by wear-resistant plastic fingers or bristles resistant to chromic acid solution and wherein a rapid flow of coating solution is maintained past the surface of the work piece in the space between the work piece and the anode. The current density between the anode and the work piece should be at between 2.5 to 3.5 amperes per square inch of anode "contact" or envelopment area and the temperature of the solution should be held within a range of 130° to 150° F. Preferably the solution strength is in the range of 20 to 30% $CrO_3$ and 0.20 to 0.30 percent $H_2SO_4$ and the solution is a mixed catalyst fluoride-type plating solution. In general, it has been discovered by the present inventor that if the brush plating operation is conducted within the correct ranges and is maintained at a steady rate once initiated that a hard chrome coating can be obtained, whereas if any significant variation in the rate of deposition or hiatus in the plating process occurs, the deposition of hard chrome ceases and cannot be reinitiated without starting the whole process again. Consequently, the anode must be continuously maintained over the area to be coated, the relative movement between the anode and cathodic work piece must be continuously maintained, the current density must be closely maintained and the strength and uniformity of the electrolytic coating solution must be maintained substantially uniform at all times. In particular, the anode surface must be maintained at all times opposite the area being coated and relative movement of the brush surface to the surface being coated maintained.

More particularly the applicant has discovered that good quality hard chrome coatings of significant thickness can be formed if care is taken to (a) initially electrolyze the surface of a lead electrode, (b) the electrode is maintained thereafter at all times with a portion of its active surface in effective anode contact with the surface of the workpiece to be coated by maintaining at least a portion of the anode surface continuously over all portions of the work piece surface to be coated, (c) the work piece surface is continuously brushed with a chromic acid resistant plastic brush surface which is a portion of an anode wrap section comprising an absorbent base material which provides or maintains electrolyte between the anode surface and the work piece and a bristled outer surface which brushes the work piece surface, (d) the current density and relative movement between the brush material and the work piece surface is maintained between strict operating limits and (e) the electrolytic plating solution is moved through the plating area evenly and at a rate preventing depletion of the chrome content. As noted above, the maintenance of a portion of the anode always adjacent the area being coated and relative movement between the anode and the work piece providing continuous brushing is particularly critical. Means for practicing the invention in an environmentally acceptable manner are also disclosed. The Applicant has discovered that with proper technique, the standard chrome plating solutions designed for tank chromizing can be used in an effective brush plating operation forming significant deposits of hard chromium coatings.

BRIEF DESCRIPTION OF THE DRAWINGS

FIG. 8 is a diagrammatic view of an alternative arrangement for isolating the brush plating arrangement of the invention from the surrounding environment while at the same time allowing completely free flow of the brush plating solution past the coating area while acted upon by the current density of the invention.

FIG. 9 is a diagrammatic view of an alternative arrangement for isolating the apparatus and process of the invention from the environment.

FIG. 10 is a broken-away side elevation of an apparatus for practicing the invention upon a journal of a roll close to the roll body.

DESCRIPTION OF THE PREFERRED EMBODIMENTS

Figure 1:
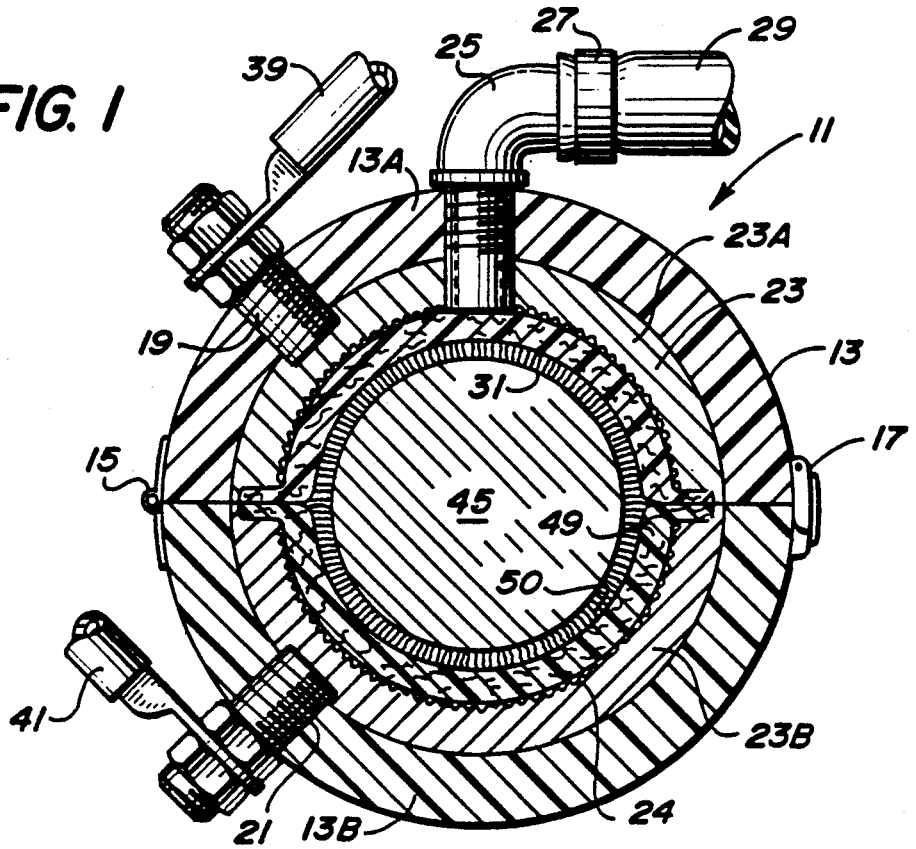
FIG. 1 is a transverse cross section of a preferred arrangement for practice of the invention.

So-called brush plating, or selective plating has come more and more to the fore, particularly since the end of the second World War, because of its convenience in making field repairs and adjustments to the surfaces of coated and damaged products and equipment and its ability in general to make harder and more wear and corrosion-resistant coatings than other electrolytic-type coatings. However, a rather critical defect or disadvantage in the brush coating, or selective coating, operation or process was heretofore its inability to produce good, hard chrome coatings of reasonable thickness. This long continued lack in the selective coating technology has now been solved by the present invention, in accordance with which hard chrome coatings of excellent properties can be easily and efficiently provided upon various work pieces.

Essentially, the present Applicant has discovered that a hard chrome coating can be made on a work piece by coating such work piece within an anode enclosure apparatus which confines the electrolytic solution to an area between the surface of the anode, which anode surface should be made from lead, or a lead composition, and the surface of the work piece. A polypropylene or other appropriate plastic felt or felt-like material resistant to chromic acid degradation is provided on the surface of the lead anode to retain the electrolytic solution continuously between the anode and the surface of the work piece while providing a substantially free flow of electrolytic solution. Likewise, a polypropylene or other appropriate plastic brush or discontinuous scraper element is provided to continuously abrade or rub the surface of the work piece to dislodge from such surface, bubbles of hydrogen as well as any contaminants derived from the coating bath.

The plastic brush, or divided scraper, must be both resistant to attack by the chromic acid material in the electrolytic solution and snag and tear resistant with respect to the coating deposit, which can become quite rough, especially around the edges during coating and will tear or shred either a weak plastic material or a felt surface if directly applied to the surface being plated. A force feed of the electrolytic solution is provided to the anode enclosure apparatus and provision is made for very rapid removal of such solution from the anode enclosure area so that there is a rapid interchange of electrolytic solution through the apparatus.

The coating temperature is held at about 140° F. (60° C.) or preferably within plus or minus 10° F. and less desirably 15° of such temperature and the current density is maintained after fully starting the process at between about 2.5 amps to 3.75 amps per square inch and preferably about 3 to 3.5 per square inch. The voltage will normally be adjusted to be about 8 to 10 volts in potential difference between the cathode and the anode.

Movement between the anode surface and the work piece surface should be in a range of about 30 to 60 surface feet per minute. It is critical that the plated surface or surface to be plated be maintained continuously adjacent to the anode surface during actual coating. This is fairly easy to arrange in a shaft-type arrangement where the work piece rotates within the anode. However, it can become more difficult to attain where the anode is being moved horizontally or the like with respect to the work piece surface. In such case, the anode must be sufficiently larger or greater in area than the surface which is actually to be coated so that there is at all times a 100% anode contact with the surface to be coated, or in other words, at least a portion of the anode surface will at all times be adjacent to the surface being coated or plated. Adjacent surfaces which are not to be coated can in such case usually be shielded with the usual shielding tape, which should be a high temperature tape designed for such masking in either electrolytic coating baths or brush plating. Lead tape may be used as thieving tape to reduce edge buildup on the coating. The type of high temperature tape used frequently with sulfamate nickel electrolytic plating baths has been found to be satisfactory.

It has also been found very important to maintain an adequate and uniform flow or actually a reasonably rapid replacement of the electrolytic solution adjacent to the surface of the work piece so that the coating is plated out substantially continuously from essentially fresh solution throughout the coating operation. If the electrolytic solution becomes deficient or depleted in chromium at isolated points or times due to insufficient flow with respect to the plating rate, the quality and hardness of the chromium coating will become unsatisfactory. The required flow of plating solution will depend upon the rapidity of plating out of the solution and, therefore, upon the current density and other factors including the chromium content of the solution and the like. In general, it is believed the flow of solution should be greater through any volume of the coating theatre with increasing current density, but in general, the important aim is to have a sufficient flow of solution to prevent depletion of the solution of platable chrome ions. When operating in accordance with the invention, it will be found that a very dense, hard chromium surface layer will be formed. Coatings of normal thickness can be made. The denseness and adhesion of such chromium layer to the underlying metal may be easily tested by grinding the surface of the chromium to determine how hard and dense it is and also whether it is well adhered to the surface.

Essentially, the present inventor has found that hard chrome coatings can be made if the coating operation is run as a completely uniform operation from beginning to end with no interruptions whatsoever in continuous plating and preferably no substantial variations in coating speed. If the plating operation should be interrupted for even a few seconds, deposition of hard chrome ceases or occasionally changes to soft chrome, and if the rate of deposition varies from time to time to any significant degree, the quality of the coating may well be detrimentally affected. Consequently, the process of the invention requires completely continuous operation within critical limits with no substantial interruptions or variations whatsoever from the beginning to the ending of coating. In other words, it has been found that the chromium coating operation is inherently much more "touchy" than the coating of other metals by a brush coating operation, but with appropriate care and the proper conditions, hard chrome coatings can be applied by brush plating.

Unlike the usual situation in brush coating with other coating metals, the chrome brush coating process simply cannot be interrupted for more than a few seconds at best without the chromizing completely stopping, requiring the entire process to be restarted from scratch. Normal brush plating technique, for example, does not require the anode to be always kept adjacent to the coating area during coating, because even if the anode passes beyond the coated area for a short period, the coating merely picks up where it left off when the anode is returned to the coating area. It has been discovered that this does not occur in the brush plating of chrome or hard chrome and that the coating process once started must be maintained at a uniform rate until completed. It has been further discovered that if the proper techniques are used with usual care, ordinary tank-type chrome plating solutions can be used.

In particular, it has been found that the anodic electrode, or anode, must be maintained in continuous effective anode contact with the surface to be coated at all times. In other words, at least a portion of the anode must be kept at all times opposite to every portion of the areas to be coated with substantially continuous movement between the two, else coating or deposition of hard chromium will cease. In a similar manner, it is very preferable for the other parameters of the coating operation to be maintained relatively constant. In the ordinary brush plating operation, on the other hand, the anode wrap is customarily provided less than full contact with the work surface at all times and other parameters are also frequently operated discontinuously with no ill effects.

While the exact reason why the coating of hard chrome has to be maintained with completely uniform conditions and why in particular, the anode surface must be kept in continuous anode contact with all portions of the work surface at all times, is not known, it is theorized that, since chrome plating solutions are relatively inefficient potential or current carriers, if the work surface moves for a moment beyond the effective anode plating or current carrying range and the potential between the anode and the work surface drops precipitously, this allows the essentially uncharged solution adjacent the coating area to inactivate or passivate the surface to be coated. Once passivated or inactivated, the surface cannot thereafter be effectively coated. In brush plating with other metals, on the other hand, the conductivity of the solution is sufficient to maintain an effective potential between the anode surface and the surface to be coated, even when the two are displaced somewhat apart and the surface to be coated is not passivated or inactivated allowing the coating or process of coating to be continued until a desired coating thickness is attained. It is emphasized that these suppositions are merely theoretical at the present time. Further investigation is continuing and may or may not confirm such theory. It may be noted in this regard, however, that chrome solutions are frequently considered to be less than 15% effective as coating solutions on an overall basis.

In FIG. 1, a partially cut-away view of a brush coating apparatus in accordance with the invention, particularly, in the case shown, for brush coating a damaged shaft or the like, is designated, in general, by the reference numeral 11. The brush coating apparatus 11 is composed of an outer plastic casing 13 which in the case of a shaft or the like as shown, may conveniently be comprised of a portion of a plastic pipe, although it will be understood it could also be comprised of any other molded casing arrangement. Such plastic pipe 13 has been severed into two casing sections, an upper section 13A and a lower section, 13B mounted together by hinge arrangement 15 and with a clasp or latch arrangement 17 on the opposite side. An upper electrode connection 19 and a bottom electrode connection 21 are shown in the form of threaded fittings extending through the casing 13 and partially screwed into two sections of lead anode 23. An upper anode section 23A and a lower anode section 23B comprise the two sections of the anode which are preferably secured to the corresponding sections of the plastic casing 13A and 13B. In the center of the upper casing 13A and upper section of the lead anode 23A, there is provided a solution feed connection 25 which is attached as shown by a clamp 27 to a solution feed hose 29. It will be understood that the electrolytic solution or plating solution will be fed via the solution feed connection 25 into the interior of the electrode chamber 31 through which the shaft to be repaired or the like also passes. Direct current, or DC, powerleads 39 and 41 provide power to the anodes 23. It will be understood also that a further groundwire from the same rectifier apparatus will be connected to the work piece or shaft within the center of the electrode assembly or brush coating apparatus 11. A rectifier apparatus used with the invention should be designed so that it has less than a 5% ripple effect in order to provide an effective plating operation. In other words, the current or current density should be kept as uniform as reasonably possible.

In the interior of the anode 23 is to be found a so-called "anode wrap" comprised of an inner plastic felt material 49 formed of a chromic acid and other chromium compound resistant material such as preferably polypropylene and an outer plastic brush material 50 also formed from a chromic acid resistant material and preferably polypropylene. Other chromic acid-resistant materials such as some polyesters and polyamides or the like can also be used. The felt material 49 is arranged or held next to the inner surface of the anode 23 and the brush material 50, which should be abrasion-resistant as well as chromic acid-resistant, is arranged or held next to the outer surface of the felt material or between the felt and the surface of the work piece. The felt material is of such consistency as to absorb and hold electrolytic coating solution received through the solution feed connection 25 and distributed preferably to the inner surface of the anode 23 in grooves or flutes 24 upon the surface of the anode running lengthwise of the shaft 45, which, in the case illustrated, is the work piece. Such flutes or grooves 24 also serve to increase the anode-to-work piece surface area or ratio to preferably about 1.5 or more. The electrolytic solution soaks, or is absorbed, through the felt material 49 to the backing of the plastic brush material 50, which backing is perforated between bristles to allow the electrolytic solution to flow through the backing into the spaces between or among the brush elements. The brush element may be unitary with the felt material, i.e. there may be a backing or perforated dividing structural wall between the felt material or section and the brush section. Alternatively, the felt and brush may be separate elements merely held or maintained together in any suitable manner. As shown, the two elements may be conveniently clamped between the two sections of the electrode sections 23A and 23B so long as the electrode sections are clamped together sufficiently tightly so there is no significant discontinuity between them. The anode wrap sections can also be held to the surface of the anode by any other convenient means or fastening arrangement. In small sections, chromic acid-resistant dacron fish line may be merely tied about the anode and the interior anode wrap to hold such anode wrap in place within the anode.

The brush element has preferably fairly short bristles as well as fairly thin bristles so that they can be reasonably easily bent over or partially "squashed down" to provide an effective brushing action without being so stiff as to mar the chromium coating as it forms by forming grooves in it. (The chromium, which is very hard, is not actually worn by the soft brush element, but the bristle elements, it is believed, interfere with the coating operation if too hard.) A very suitable brush element made from polypropylene by molding or possibly by dynamic extrusion has a backing of about one hundredth of an inch (0.01 inch) in thickness, individual bristles which are approximately one hundredth of an inch (0.01 inch) in diameter, about thirty-five hundredths of an inch (0.035 inch) in length and which are spaced in rows with approximately seventy-five and twenty five-hundredths of an inch (0.075 and 0.025) between bristles along the rows. The shorter spacing is arranged transverse to the relative movement between the anode and the work piece surface to provide a thorough brushing of the surface to keep bubbles off such surface. The outer ends of the brush bristles are preferably round or arcuate and smooth. Other arrangements or specifications are possible. The bristles should be fairly short so as not to provide too much of a flow area between the backing and the surface of the work piece and should not be too thick or stiff so they do not rub or abrade the surface too severely during coating. Too stiff bristles may cause grooves to form in the surface during coating, even though the chrome is very hard. There must be flow openings or orifices through the brush backing at spaced intervals to allow circulation of electrolyte from the absorbent felt area to the bristle area.

Figure 2:
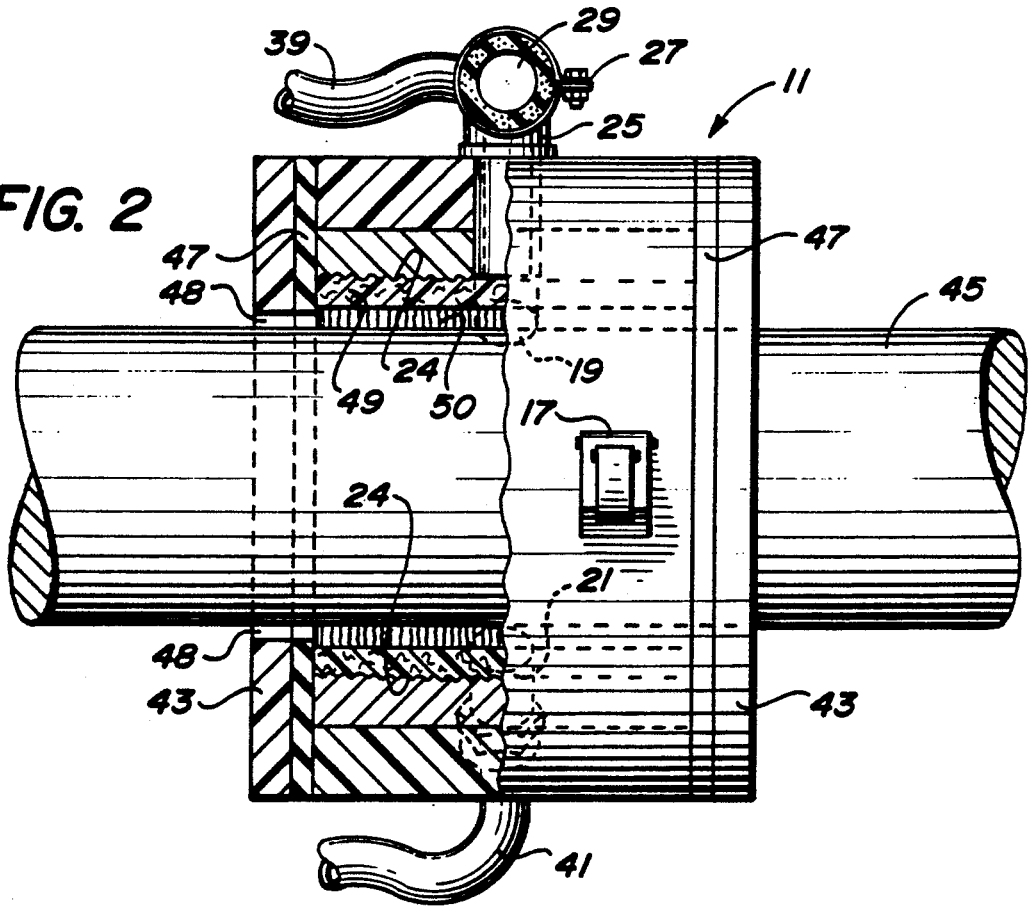
FIG. 2 is a partially broken away side elevation of the arrangement shown in cross section FIG. 1.

FIG. 2 shows a side view or elevation of the brush coating electrode apparatus assembly shown in FIG. 1. The same structures are designated by the same reference numerals in the two figures, including the plastic casing 13 and the solution feed line or feed connection 25. It will be noted in FIG. 2 that the feed connection is not only provided at the highest point of the circumferential chamber within the coating apparatus, but is also positioned more or less in the center of the longitudinal length of such coating chamber. However, for long shafts or other work pieces, there may be two or more feed connections. As emphasized earlier, it is necessary to maintain a relatively constant and uniform supply of fresh, or at least uniform, electrolyte between the anode and the shaft or work piece surface, and for long shafts or work pieces, multiple feed connections may be necessary to accomplish this in some installations. The inner portion of the anode surface 24, as noted, is corrugated longitudinally of the shaft in order to provide an increased ratio of effective anode surface-to-work piece surface and such grooves also, since the porous plastic felt material 49 does not enter such grooves, but rather merely wraps about the shaft, serve to provide a fairly uniform transfer of electrolytic solution from the feed line 25 along the longitudinal extent of the shaft and allows its direct entrance into the upper portion of the plastic felt material 49 and hence through the perforated backing of the brush element 50 into the bristle area of the brush element along its length.

Two further structures are shown in connection with the apparatus in FIG. 2, namely, plastic flanges 43 positioned on the ends of the coating chamber or brush coating apparatus assembly. Such flanges 43 were, in early versions of the invention, provided with suitable flexible gaskets sealing the flanges against the edges of the shaft 45 extending through the center of the plastic flanges 43. In such arrangement, a large gasket 47 was also used on either side or either end of the apparatus between the plastic flanges 43 and the plastic casing 13 to form a seal between the plastic flanges and the casing. A similar gasket was also extended against the edge of the shaft 45 to prevent the electrolytic solution from leaking freely from the opening between the plastic flanges 43 and the surface of the shaft 45. Such gasket could be a continuation of the outer gasket 47 or a separate gasket arranged around the shaft.

Along with such sealed arrangement, there was provided a central drain more or less opposite to the feed line 25 to drain away the electrolytic solution, the theory being that the solution would enter the center of the casing at the top, flow toward the ends, and then reverse and flow at the bottom toward the drain in the center. While such arrangement operated after a fashion, it has been found very much preferable for the electrolytic solution to be allowed to leave the brush coating operation in the direction in which it initially flows. Consequently, the preferred arrangement is to inject the coating solution centrally in the apparatus at the top of the casing, allow it to flow toward the ends and then allow it to leave the coating field outwardly in a clearance between the end flange 43 and the shaft. It has been found that this arrangement improves the operation and quality of results by a factor of at least two. Such improvement effects a better maintenance, it is believed, of the uniformity of the composition of the electrolytic plating solution during plating, avoiding localized or even general depletion of chromium ions from the electrolytic solution.

Consequently, it has been found that a central solution drain is insufficient to drain the solution from the internal chamber of the brush coating apparatus assembly sufficiently rapidly to provide a change of coating or electrolytic solution adequate to provide uniform operation. It has been found from experimental work that if used solution from which many of the metallic ions have been plated out tends to become isolated or trapped in the ends of the apparatus away from the central drain, a slight differential concentration of metal ions appears in the solution. This results in a variation in the effective coating rate in the same manner as a varying current density will cause a variation in the coating rate resulting in a possible cessation of chromium deposition or decrease in density of the chromium deposit which cannot thereafter be regained. It has been found that this problem can be overcome by removing the portion of the gasket about the shaft and allowing the electrolyte solution to freely drain through the openings in the side of the apparatus between the plastic flange and the shaft and out the space 48 which the gasket 47 might normally close off. Such free flow of solution allows a continuous fairly rapid change of electrolytic solution as the metallic ions in it are thrown down or plated out upon the shaft and prevents the electrolytic plating solution from having any significant dwell period within any portion of the apparatus. In particular, such arrangement allows a solution which is flowing in from the central solution feed 25 to spread out evenly, both downwardly about the circumference of the coating chamber and outwardly towards the flanges of the coating chamber. Since the solution is now also able to leave the coating chamber at the ends by simply flowing out, such solution maintains essentially its full concentration of the coating metal ions and is rapidly renewed so that such concentration does not tend to decrease with the coating operation. At the same time, the current density may be reduced somewhat to further assure that the solution does not become significantly depleted in coating metal before it passes out of the apparatus to be renewed.

Figure 3:
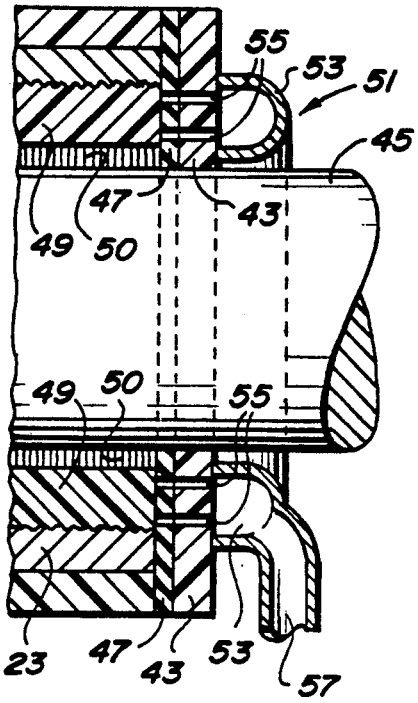
FIG. 3 is a longitudinal cross section of an arrangement for effectively removing coating solution from the cite of coating in the brush coating operation to maintain a continuous flow of such solution with no variation such as might be caused by stagnate areas.
Figure 4:
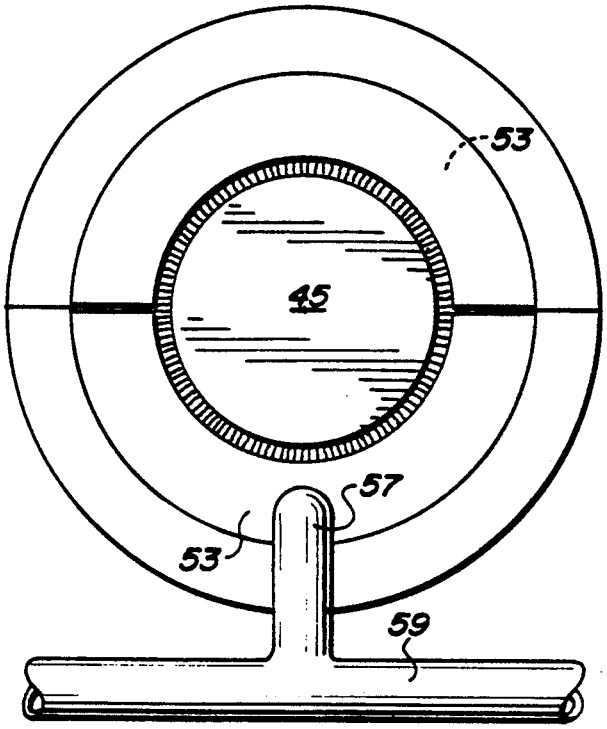
FIG. 4 is an end elevation of the electrolytic solution removal arrangement shown in FIG. 3.

As will be understood, merely removing the gasket 47 on both sides and allowing the solution to escape freely from the chamber, while it dramatically increases the efficiency of the coating operation and the quality of the coated product produced, also may have detrimental environmental implications due to the spilling out of the electrolytic solution into the surroundings. Electrolytic chrome solutions, in particular, have a significant tendency to form an objectionable mist, especially when warmed or heated. It is preferred, therefore, to provide auxiliary drain apparatus at the two ends of the coating apparatus assembly, as shown in FIG. 3, which is a side view of one end of a modified version of the coating apparatus of FIGS. 1 and 2. In FIG. 3, wherein the same reference numerals are used to indicate the same structures as already shown in FIGS. 1 and 2, there is shown a further auxiliary drain system 51 provided on both sides of the plating apparatus, only one of which drain systems is shown in FIG. 3, to freely drain away the coating solution and prevent it from evaporating into or otherwise contaminating the surrounding atmosphere. Such auxiliary drain system 51 may comprise various arrangements. However, in the arrangement shown in FIG. 3, the drain system comprises an arrangement wherein a hollow drain ring or chamber 53 is mounted on the side of the plastic flange 43 and a multiplicity of drain holes 55 are provided or bored through the plastic flange from the interior of the coating chamber to the inside of the circumferential drain chamber 53. The drain holes will also be seen to pass through the gasket 47 to allow free drainage of electrolytic solution from the interior of the coating chamber near the surface of the shaft 45 which is being plated. FIG. 4 shows a side view of such arrangement in which can be seen the drain chamber 53 extending circumferentially upon the plastic flange or plate 43 about the shaft 45 adjacent to the inner edge of the flange 43 of the coating assembly apparatus where it surrounds the shaft so that the drain passages 55 lead from a point adjacent to the surface of the shaft 45 from the interior of the apparatus into the circumferential drain chamber 53. An auxiliary solution drain 57 then conveys the used electrolytic solution collected in the circumferential drain chamber 53 and recirculate it back to a solution storage reservoir, not shown, where it is mixed with fresh solution material and recirculated after replenishment into the solution feed for the apparatus. As will be understood, the solution drain 57 may most conveniently be connected to and drained into a general manifold 59, see FIG. 4, which returns the solution to the reservoir and any make up apparatus, not shown. The drain arrangement shown in FIGS. 3 and 4 is very effective in rapidly and efficiently draining away all excess solution from the coating chamber. It will also be understood, however, that other effective drain systems may be devised which will also effectively drain away all the solution fast enough so that there is substantially no dwell time of such solution within the coating chamber and the effect or result is substantially as though there was nothing preventing the solution from flowing freely from the ends of the chamber to the environment with no build up whatsoever of the solution within the chamber. A further alternative arrangement for draining the solution is shown in FIG. 8 described hereinafter. While it has been found that a central drain arrangement is undesirable, in general, and an end drain is preferred, it is believed that an efficient central drain might be designed including perhaps a special arrangement of grooves in the lower anode to effectively lead the used solution to the drain and proper venting in the drain to avoid air lock and the like.

A very important portion of the coating assembly shown in both FIGS. 1, 2 and 3 is the plastic felt-like lining 49 which extends completely around the interior of the coating chamber next to the surface of the work piece which is to be coated. Such plastic felt-type material 49 into which the coating solution is directly flowed from the solution feed connection 25 effectively distributes the electrolyte solution and holds it, not only on the bottom of the coating chamber, but on the sides and top as well, in an even, moist condition which very effectively distributes the material about the coating chamber. The plastic felt material is preferably formed from a polypropylene material which is uneffected by chromic acid.

The inside of the anode 23, as explained above, is fluted or grooved to increase the ratio of the anode surface to the smooth work piece surface and such fluting 24 is oriented to run longitudinally of the shaft. The plastic felt-like material preferably does not dip into the flutes, but instead passes across them, leaving channels through which the electrolytic coating solution may more or less freely flow towards the ends of the channels so it is quickly and easily distributed over the outer surface of the plastic felt and the felt is completely saturated by the solution.

Another important part of the interior configuration of the coating system is the use of a polypropylene brush material 50 upon the inside surface of the felt material 49. Such polypropylene brush material 50 serves to continuously brush or rub the surface of the work piece rotating within the chamber to remove bubbles of hydrogen which otherwise may form on the cathodic surface and block the ready access of the coating solution to the surface as well as to generally remove any solution derived particulates or the like which may form as contaminants upon the surface of the coating. The plastic felt material 49 is, as indicated, also formed preferably of polypropylene in order to be uneffected by the chromic acid in the bath. The plastic brush material 50, while adjacent to the plastic felt material 49, may constitute a separate layer so there are two separate layers in contact with each other or each may constitute different parts of a single structure having a felted-type texture in the inner portions next to the lead anode and a brush-type structure in the outer portions next to the cathodic work piece. In either case, there must be access orifices in any barrier between the two layers to allow free flow of electrolyte from the felted-type material to the brush material against the work piece. It is necessary that the plastic felt-type material 49, which may in some cases take the form of an open cell plastic foam-type material through which liquids may easily migrate from one portion to another, serve to quickly conduct the coating solution in an even layer about the metal piece being coated and to hold an even supply of coating electrolyte at all times adjacent to the surface of the work piece, or more properly the brush section 50, which is saturated with the electrolyte so that the work piece is at all times entirely surrounded by and immersed in such electrolyte. The felt-like material 49 may also be a true felt-type material formed of a polyolefin such as preferably polypropylene or other suitable plastic or polymeric material. Such felted material may be formed of matted polypropylene or other suitable polyolefin fibers.

During operation, the plastic brush-type material 50 continuously brushes the surface of the work piece to make certain that no bubbles build up or collect to obscure the surface from the coating action of the electrolytic solution. It is important not only that the brush-type material be unaffected by chromic acid, but that it also be strong and wear-proof as well as having a minimum tendency to snag upon a rough surface of the depositing chrome.

It is also important to the present invention that the surface of the anode be electrolyzed prior to the beginning of the plating operation. This may be accomplished by placing the anode initially in a bath of the electrolyte and passing direct current through the anode for about two hours. This forms a chromium oxide surface on the anode and renders it essentially impervious to the solution and any changes during the actual coating operation. In effect, the surface becomes a chrome-lead surface which may operate for long periods in the bath without significant change in surface characteristics.

It is convenient in practicing the invention for the work piece to be a round work piece such as a shaft or the like, since it is easy in such instance to make certain there is continuous movement between such shaft and the surrounding electrode, as well as to ensure that all portions of the shaft to be coated are continuously opposed by sections of the anode at all times. However, the present invention is also operative with other than round work pieces, for example, with flat work pieces.

Figure 5:
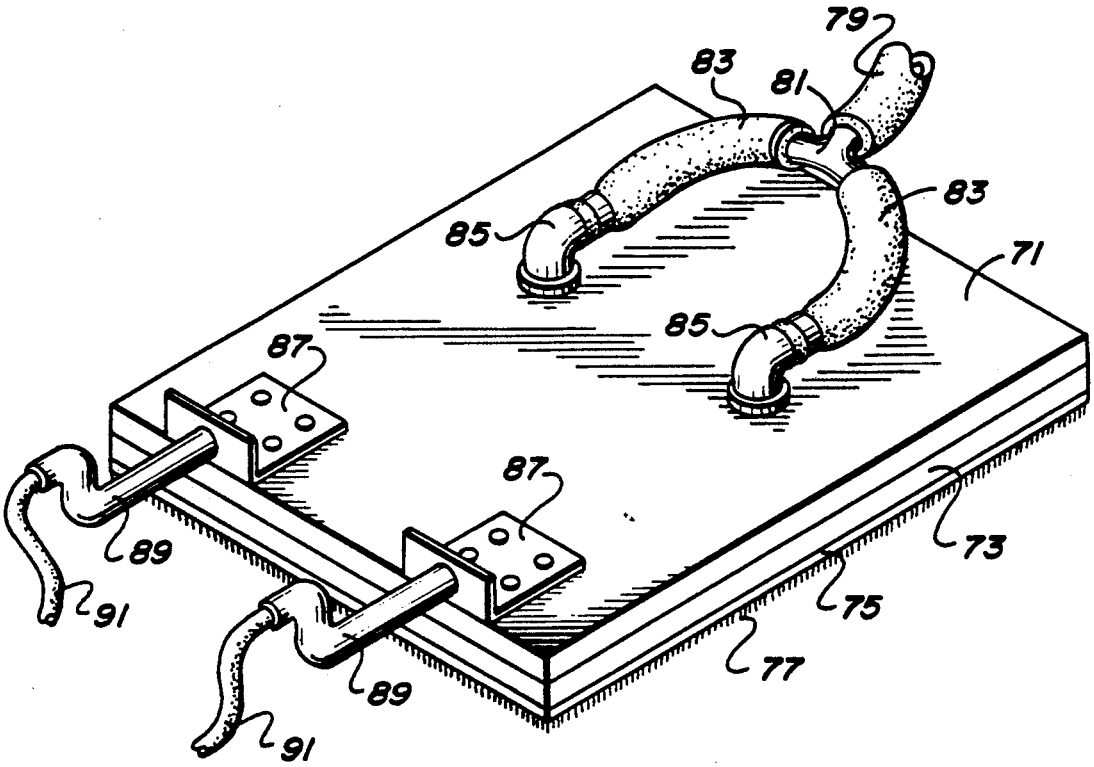
FIG. 5 is an isometric view of an arrangement for practicing the invention on a flat surface.

In FIG. 5, there is shown an arrangement for coating flat sections of a metal work piece, in which a plate 71 formed from plastic or the like is attached directly to a lead-tin anode 73 which in turn has a plastic resin or polypropylene felt-type material 75 attached to its surface and a polypropylene brush-type material 77 attached to the lower portion of the polypropylene felt material. A solution feed line 79 leads from a source of electrolytic coating solution, not shown, to a Y-section 81 where the feed is divided into two separate lines 83 which are connected by fittings 85 to two locations on the top of the plastic plate 71. Fairly close to these inlets for the coating solution are two stainless steel or copper connectors 87 which are connected by stainless steel bolts through the plastic plate 71 to the lead tin anode 73. Electric connections 89 may be in the form of plastic tubes which may serve also as insulated handles through which lead wires 91 from a power source pass to the connectors 87. It will be understood that the insulated handle sections 89 may actually be longer and/or heavier in order to provide a good grip for the operator, who basically holds the plate or anode apparatus and continuously moves it over an underlying work piece during coating. Alternatively, other suitable handles may be used or other mechanical movement apparatus may be provided.

It will be understood that during operation of the apparatus shown in FIG. 5, the coating solution enters the plastic felt material 75 via the coating solution connections 85 and fluting or grooves on the surface of the anode, which fluting also serves to increase the anode to work piece surface ratio, and is quickly spread out across the bottom of the plate contained evenly in the felt material and between the plastic bristles of the brush material and essentially filling the space between the material to be coated and the anode 73. Used electrolytic solution will flow freely from the sides of the plate 71 assuring that at all times there is a fresh solution of material flowing not only in the plastic felt or sponge material 75, but also between the bristles of the brush material 77 from the connectors 85 towards the edges of the plate. It may in some cases be advantageous to provide a round or curved exterior to the plate 71 so that the edges of the plate are always equidistant from the solution entrance fittings 85 to provide an even flow of electrolytic coating material across the plate at all points. However, it will be understood that the distribution of the fluting or channels on the surface of the anode can be arranged also to obtain an essentially even distribution of coating solution regardless of the exterior shape of the anode.

It will be understood that while the arrangements shown will provide an even flow of material with a resulting very excellent coating function, one disadvantage is that the electrolytic solution ends up on the outside of the apparatus possibly causing misting as well as other possible air pollution effects. This detrimental effect can be avoided in various manners such as, for example, by providing a continuous drain along the outside of the plate having a gasket or squeegee-like moving dam which will contact the upper portion of the plate maintaining the electrolytic material within the confines of the drain defined by the gasket or squeegee. In a preferred arrangement, there may be a solution circuit which draws the electrolytic material from the surface of the material being plated into a solution circuit and returns it to a reservoir where it is mixed with fresh solution and/or replenished and recirculated back to the plate. Such an arrangement is shown in FIG. 6 described below, which briefly illustrates an arrangement having a drain about the surface of the plate in a position to drain all free material passing from under the plate into the drain portion and remove it for return to a feed tank.

The above described arrangement can only be used where the relative area of the plate as a whole, and the portion of the plate which is to be plated are sufficiently disparate in size or area and the portion to be plated is sufficiently centralized so the movable drain portion does not move off the side of the plate. Also, since the surface of the plate which is by necessity to be exposed to the plating solution, but not plated, is usually masked by shielding tape, the surface may not be conducive to the passage of gaskets across such surface. However, the principle that the operation must, of necessity, be isolated from the environment is illustrated by the arrangement shown in FIG. 6, even though it may be applicable only in specialized instances. A more practical arrangement in most cases, at least for small operations, involving the use of a shielding tent, is shown in FIG. 9.

Figure 6:
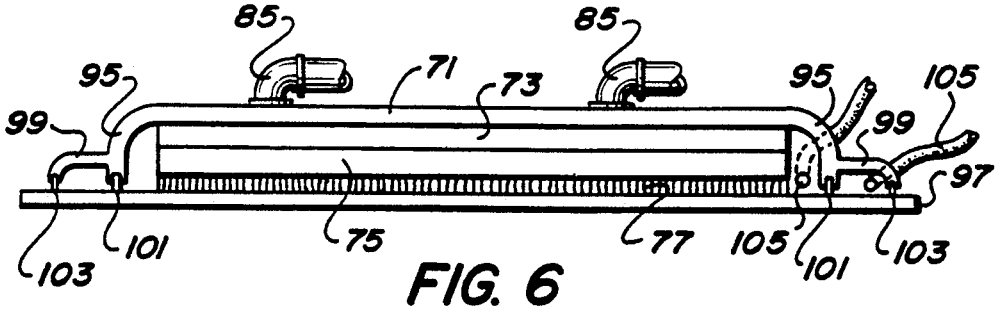
FIG. 6 is a side elevation of the arrangement shown in FIG. 5 including, partially broken away, a further arrangement for continuous removal of plating solution from the brush coating theatre of operations.

Since, in accordance with the present invention, it is critical that the anode be maintained continuously adjacent to all parts of the work piece to be coated so that the parts are continuously exposed to a constant current density and there are no interruptions in the coating operation which will cause thin or defective chrome plating to form rather than the hard dense heavy chrome deposit which is sought, it is necessary in an arrangement such as shown in FIGS. 5 and 6 for the coating plate to be larger than the section of the material which is to be coated. Preferably, the anode should be at least 1.5 times as large as the area to be coated or plated and may desirably be as much or more than 2.0 times as large as such area in order to make certain that as the anode is moved continuously the surface of the work piece is constantly stroked with the brush processes in the area to be coated in order to continuously and completely dislodge any bubbles which might interfere with coating. In other words, the anode must be large enough so that it can be moved to the side without passing from over the top of the section of the work piece which is to be coated. Since it is desirable for the movement of the anode to be more or less random, or at least not in a straight back-and-forth motion, such additional area is desirably provided on all sides of the anode so that a 50% increase in area actually does not provide a great deal of additional area on any one side.

It is also important that the surface of the anode be fluted to produce at least a 1.5 to 1 ratio of the surface area of the anode to the surface area which is to be coated. Even higher ratios may be desirable. As indicated above, this same ratio also applies with respect to the apparatus shown in FIGS. 1 and 2. This reduces the formation of trivalent chromium in the plating solution which is undesirable in a hexavalent plating operation. The same would be true, however, in a trivalent plating solution where it would be desirable to avoid the formation of hexavalent chromium in the coating solution. Normally, the differential movement between the cathodic work piece and the anode will be provided by regularly moving either the work piece or the anode and attached brush sections relative to the other members by some mechanical movement engendering device.

FIG. 6, as indicated above, shows a side view of a modification of the arrangement shown in the isometric view of FIG. 5. In FIG. 6, the same central dielectric plate section 71 with a lead anode 73 attached directly to it and to which in turn is attached a plastic felt material 75 and finally a plastic brush material 77, is shown as is also shown in FIG. 5. Two fittings 85 are shown for providing electrolytic coating solution to be applied to the plastic felt material 75. It will be understood that the embodiment shown in FIG. 6 is square like the embodiment shown in FIG. 5. However, as indicated above, the outer shape of the material could also be curved so as to provide a more or less equal distance to the edges of the coating plate from each one of the solution inlets. This has advantages in assuring equal dwell times of the electrolytic solution between the surfaces of the work piece and the anode surface at all times.

In addition to the parts shown in FIG. 5, there are also shown in FIG. 6, solution drain sections 95 which are curved sections curving from the top of the plastic plate 71 toward the surface of the work piece 97 with a squeegee-type gasket arrangement 101 on the end of such sections 95 contacting the surface 97 of the work piece. These sections 95 form in effect, tubular drainage sections about all the edges of the coating plate apparatus. A further tubular section 99 is shown to the outside of the section 95. Section 99 provides a further drainage section which is designed to take up any liquid which may escape through the squeegee-type sponge or sponge-type gaskets 101 on the bottoms of the sections 95. It will be understood that the sections 99 also are provided with similar squeegee gaskets 103 which prevent the liquid electrolytic material from flowing outwardly of the sections 99 so that no electrolytic material is exposed to the atmosphere where it might cause fumes, mist or other toxic conditions. Drains in the form of forced drains 105 lead from the two chambers 95 and 99 or, more particularly, the volume within the members 95 and 99, and the solution picked up in such drains is pumped to a central heated reservoir where it may be mixed with back up solution and returned to the coating apparatus through the inlet fittings 85. Alternatively, and even more preferably, a gravity drain could be arranged to remove used electrolytic solution. As indicated above, the arrangement of FIG. 6 is useful only in certain instances and a more widely practical arrangement is shown in FIG. 9 for example.

Figure 7:
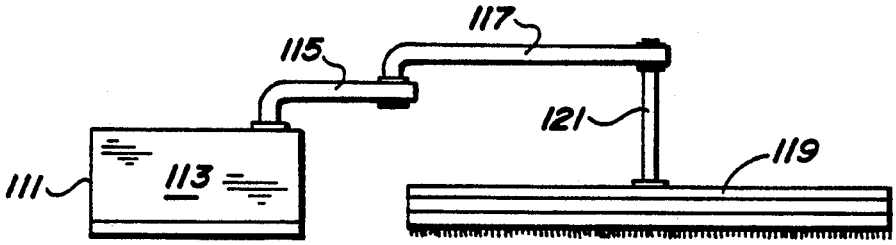
FIG. 7 is a side elevation of a means for continuously moving the apparatus shown in FIGS. 5 and 6 to obtain continuous movement of the brush coating anode over the surface of the metal piece being coated.

FIG. 7 is an illustration of a mechanical device for moving the plates shown in FIGS. 5 and 6 continuously in a varying pattern in order to attain or maintain continuous movement of the plastic brush elements against the plating surface to prevent the build up of any gaseous hydrogen or the like. As indicated above, the device is shown basically diagrammatically to illustrate the principal rather than the exact device. It will be understood by those skilled in the art that there are various of these devices made by several manufacturers to provide a continuous movement of one work piece or element with respect to a second work piece or element. Usually the differential movement provided is a figure eight or modified figure eight-type pattern. In FIG. 7, a base 111 will be understood to contain or support a motor illustrated schematically as 113 from the top of which a rotatable or, alternatively, a reciprocal arm 115 extends and on the end of which arm 115 there is a second arm 117 which, it will be understood, is usually maintained in one orientation, but which may also be reciprocated from side to side by a suitable mechanical arrangement. A coating plate 119 which, as will be understood, is similar to the coating plates shown in FIGS. 5 and 6, is attached by an arm 121 to the arm 117. It will be understood from the sketch shown in FIG. 7 that as the two arms 115 and 117 continuously travel in an arcuate pattern or in some other pattern with a reciprocable motion, that the plate 119 will be moved into various positions with respect to the base 111, depending on the relative position of the two arms with respect to each other. As a result of the rate of rotation or partial reciprocable or arcuate motion of the two arms, the motion of the plate, although regular on a long term basis, will, on a short term basis, be irregular following a different pattern of movement from minute to minute.

As indicated and explained above, the anode can never be brought beyond the area of the work piece which is to be coated with a hard chrome coating, else the deposition of the chromium will be interrupted resulting in either a defective or thin chromium coating or plating rather than a hard thick chromium coating as desired. Once the plating operation stops even for a second or two or even occasionally a fraction of a second, it cannot be restarted except by starting over from the beginning including reactivation of the electrolyte. In order to obtain a reasonably thick hard chrome deposit, therefore, it might be necessary to restart the plating operation ten or more times, which is completely impractical. In the usual brush plating operation, on the other hand, it is customary to have brief times when the area of the work piece to be coated is not completely covered by the anode, no special precautions being taken and, in fact, in the plating of shafts it is the normal practice to use a discontinuous electrode in order to obtain an easier matching of the electrode surface to the curvature of the shaft. It has been found by persistent experimentation that this is not possible when plating with a hard chromium deposit, however. As indicated above, while the exact reason the deposition of a hard chrome coating requires continuous effective anode contact with the surface to be coated is not known, it is believed or theorized that the lower conductivity of a chrome plating solution requires the continuous opposition of the anode with the surface to be coated to prevent the surface from becoming passivated or being inactivated by the coating solution when no significant current or potential is active between the two.

It will be understood, therefore, that the anode cannot at any time during the plating process pass beyond the area of the work piece which is to be coated with a hard chrome coating, else the deposition of the chromium will be interrupted, resulting in a defective or thin chromium coating rather than a thick hard chromium coating, as desired. It will be understood, therefore, that the size and swing of the arms 115 and 117 will be adjusted so that the movement of the plate 119 at any given moment will never bring any portion of a work surface which is to be coated with a hard chromium coating beyond the position of the surface of the lead anode or, more precisely, will not bring the electrolyzed surface of the lead anode beyond any portion of the area of the work piece which it is desired to coat or plate with hard chromium. As indicated above, this relationship is extremely critical, since it is important that the same substantial current density be maintained continuously during coating between the coating anode and every portion of the work piece surface which is to be coated with the hard chromium coating. If such current density drops or varies significantly or the coating rate otherwise varies significantly once begun, the production of hard chrome may essentially cease and thereafter cannot again be restarted for the particular chrome plating deposits, except by going through the usual entire preparation procedure for beginning plating, an impractical and time consuming exercise.

FIG. 8 is a side illustration partially broken away of a very practical and somewhat preferred alternative arrangement for assuring a rapid even removal of coating electrolyte from the ends of a shaft being coated in accordance with the invention. In FIG. 8 the ends of the plastic flange 43 extend to within a half inch or so of the surface of the shaft 45 being coated and adjacent to the plastic felt 49 formed preferably of polypropylene or other suitable polyolefin or other plastic resin and the similarly formed bristles of the brush section 50 leaving an opening 125 through which the solution may freely pass into a circumferential drainage chamber 127 about the surface of a shaft 45. The circumferential drainage chamber 127 is formed by an arcuate or other shaped shield member 129 having a suitable circumferential gasket 131 on the lower or outer end contacting and sealing with the surface of the shaft 45 to prevent escape of electrolytic solution as a vapor or mist to the environment. A drain line 133 is provided to rapidly drain the electrolytic solution from the circumferential chamber 127. It will be recognized that the arrangement shown in FIG. 8 is essentially an adaptation of the drain system shown in FIG. 6 for a flat member or work piece to use with a round or cylindrical work piece. Such an arrangement is more practical in general to use with a shaft because the contact area of the shaft with the confining gasket is not usually encumbered with masking or thieving tape and there is no edge of the work piece for the gasket to pass beyond. The anode, felt-like material 49 and brush-like material 50 are shown only on the upper side of the shaft 45 in FIG. 8, but it should be understood that such anode and anode wrap material extend completely around the shaft and would appear, therefore, also on the lower side of the shaft.

FIG. 9 is a diagrammatic view of an alternative and somewhat old fashioned, but still effective, arrangement for brush coating with an unrestricted flow of electrolytic coating solution. In FIG. 9 a tent or flexible moisture shield 135 has been erected over a brush plating arrangement 137 including a support 130, a flat work piece 141, an anode plate 143 with a lower anode wrap material, not shown, and a variable movement mechanism 145 which supports and moves the anode plate 143 through a rotatable or reciprocatable arm 146. The entire apparatus sits or rests in a drain pan 149 which has a drain 151 leaving one side and entering a centrifugal pump 153. The centrifugal pump 153 pumps the electrolytic fluid drained from the drain pan 149 to a heated reservoir and make-up tank 155 which is heated by a convection heater 157. The fresh or readjusted electrolytic solution is then delivered via centrifugal pump 159 and rigid feed conduit 161 plus flexible feed line 163 to the anode plate 143, which, it will be understood, includes a support plate, a lead anode, a plastic felt material and a plastic brush section; all as described previously in connection with earlier figures. The use of a centrifugal pump 153 to remove electrolytic solutions from the drain pan 149 is shown as one alternative and for convenience of illustration only, since in most actual arrangements the reservoir and make-up tank 155 would be located at a lower level than the drain pan 149 and used electrolytic solution would discharge into the reservoir 155 by gravity.

The chromic acid content of the electrolytic solution should preferably be in a range of about 20 to 30% and preferably about 25% $CrO_3$ and it should contain about 0.25% $H_2SO_4$ and be maintained at a temperature of about 130° to 150° Fahrenheit or preferably about 140° F., or 60° C. As indicated previously, the current density is maintained at between 2.5 to 3.5 amperes per square inch of anode contact area at a voltage of about 8 to 10 volts. The sulfuric acid content can vary between about 0.2% and 0.3% $H_2SO_4$. There are various proprietary and commercially available chrome coating solutions which may be used. Ordinary tank plating solutions are usable with the arrangement of the invention and special brush plating solutions are not required. Special commercially available analysis apparatus 144 to continuously monitor the analysis of the electrolytic solution and replenish apparatus 148 to bring the analysis back into a predetermined balance is shown mounted upon the make-up tank 155.

Figure 11:
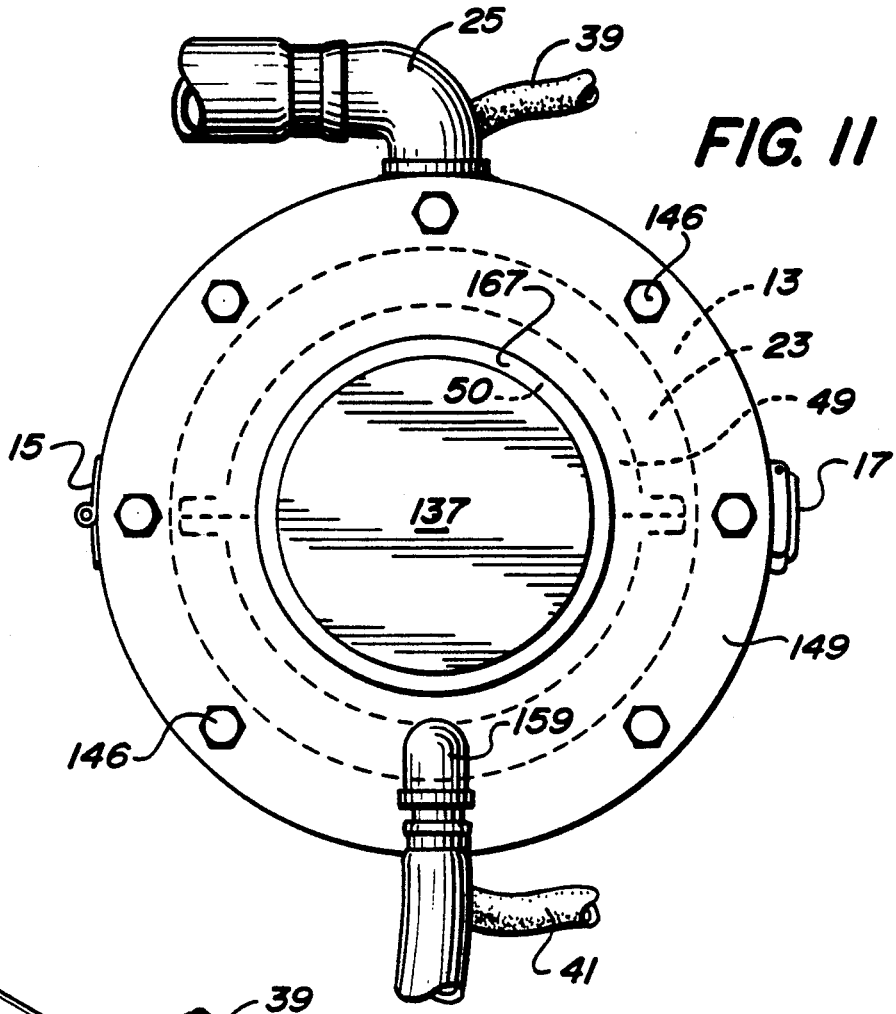
FIG. 11 is a partially broken-away end view of the apparatus shown in FIG. 10.

It is frequently desirable to chrome plate the journal of a roll or a portion a journal of a roll close to the main or working portion of the roll, i.e. to the roll body. In such case, the arrangement for draining the used electrolyte shown in any of FIGS. 1, 2, 3 and 8 will not be possible at one end of the coating apparatus, since the anode 23 must be moved very close to the enlarged central working section of the roll. In such instance, however, the electrolytic coating arrangement shown in FIGS. 10 and 11 has been found to be very practical. In FIGS. 10 and 11, the same reference numerals have been used to designate the same structures as in the previous figures. In FIG. 10, a lead anode 23 corrugated or fluted on the inner surface is provided with a polypropylene felt material 49 over the surfaces of the anode adjacent to the top surfaces of the flutes 24 upon the anode surface and a plastic brush material 50 extends over the outer surface of the plastic felt 49. As indicated previously, these plastic resin members are preferably made from polypropylene which is unaffected by chromic acid and related corrosive chromium compounds. The anode 23 is contained within a dielectric casing 13 and is mounted over a journal 137 of a roll 136 having a main body section 139 which is considerably larger than the roll journal 137. The plastic casing 13 has at the end adjacent the roll body a plastic cap plate 148 which closes off this end of the casing, except for the short section of the journal 137 which extends through such cap plate. The plate 148, which as shown is composed of two longer somewhat flexible adjacent members 148A and 148B and a shorter resilient gasket member 148C, is provided at the lower or inner end with a narrow ribbon or hoop-type seal 150 extending about the journal 137 and preferably secured or sealed to the edge of the plastic cap plate 148 about the orifice, not shown, in the plastic cap plate 148 through which the journal 137 extends. The other edge of the ribbon or hoop seal sealingly contacts the edge of the roll body 139 on the opposite side so that the escape of liquid in the small clearance between the roll body 139 and the outside of the plastic cap plate 148 is prevented. As indicated, there is insufficient space between the anode apparatus and roll body to allow the convenient use of an actual drainage arrangement at this end of the anode apparatus. The plastic cap plate 148 is preferably securely attached to the plastic casing 13 by screw, bolt, or other threaded fastenings 152 shown entered into the casing 13 in the cross sectional portion of FIG. 10.

At the opposite end of the casing 13, there is shown a second heavy section plastic cap plate 154 which is also attached to the plastic casing by suitable threaded fastenings 152. Such threaded fastenings extend through a circumferential end gasket 156 having a substantial section which spaces the cap plate 154 from the end of the plastic casing 13 by the thickness of the end gasket 156. The space between the second cap plate 154 and the anode 23 as well as between the cap plate and the plastic felt material 49 and plastic brush material 50 is completely open and serves as a free-flow drainage opening or chamber 158 at the one end of the anode apparatus into which used electrolytic solution can flow to maintain a rapid flow of solution from the end of not only the brush material 50, but from the plastic felt material. 49 and also the flutes 24 indicated diagrammatically by a broken line in FIG. 10. At the bottom of the drainage chamber 155, there is provided a drain fitting 160 extending through the end cap 154 preferably more or less opposite the end of the anode 23. Connected to the drain fitting 159 is a solution drain 162 provided with a "Y" fitting 163 with a vent section 165 which vents the drain and prevents the system from becoming air-bound and possibly preventing free flow of the electrolytic solution from the drainage chamber thereby possibly allowing depletion of the metallic values of the electrolytic solution and detrimentally affecting the chromium plating operation.

Since the drain chamber 155 is positioned only at one end of the anode apparatus, it is desirable to establish a flow of electrolytic solution from the other end of the anode apparatus to prevent the solution from becoming stagnant at that end. In order to attain a straight-through flow, therefore, the solution feed fitting may even more preferably be provided at the far end of the anode or brush coating apparatus 11 rather than in the center as shown. However, it will be understood that various arrangements of the flutes 24 at the surface of the anode and next to the plastic felt material may be used which might conduct the electrolytic solution generally on a complete circuit from the solution feed to the solution drain chamber. It is very desirable, however, that no "dead areas" occur where drainage of the solution is impeded and where depletion of the chromium content may occur interfering with proper chromizing of the work piece. The upper power feed 19 and bottom power feed 21 may be positioned at various convenient locations, since the charge of the electrode 25 is, in general, evenly distributed over at least most portions of the electrode.

A suitable tight fitting circumferential seal 167 is provided over the journal 137 of the roll 136 with its side abutted against the outside of the cap plate 154. The seal 167, which is removable, is positioned tightly against the surface of the cap plate 154 to prevent electrolytic coating solution from flowing from the opening, not shown, in the plate through which the journal 137 extends. The seal 167 rotates with the journal 137 while the anode apparatus is held stationary over the journal providing the necessary relative movement between the journal and the anode and particularly the polypropylene brush to provide the necessary continuous brushing of the surface of the journal being chromized.

It will be understood that if the work piece being coated was a straight shaft or substantially a straight shaft rather than a journal of a larger roll body, an anode coating chamber similar to that shown in FIGS. 10 and 11 could be used while incorporating a drain chamber at both ends rather than just one end and having the solution feed fitting 25 essentially positioned in the center of the apparatus more or less midway between the solution drain chambers at both ends.

It should be noted that rolls and the like may have journals or shafts having various diameters as well as a larger central roll body. The anode arrangement shown in FIGS. 10 and 11, therefore, is equally usable with all such unequal sized journal arrangements where the brush coating anode may by necessity be required to be essentially butted up against a larger diameter section on one side while repairing or coating the surface of a smaller section of the journal.

Figure 12:
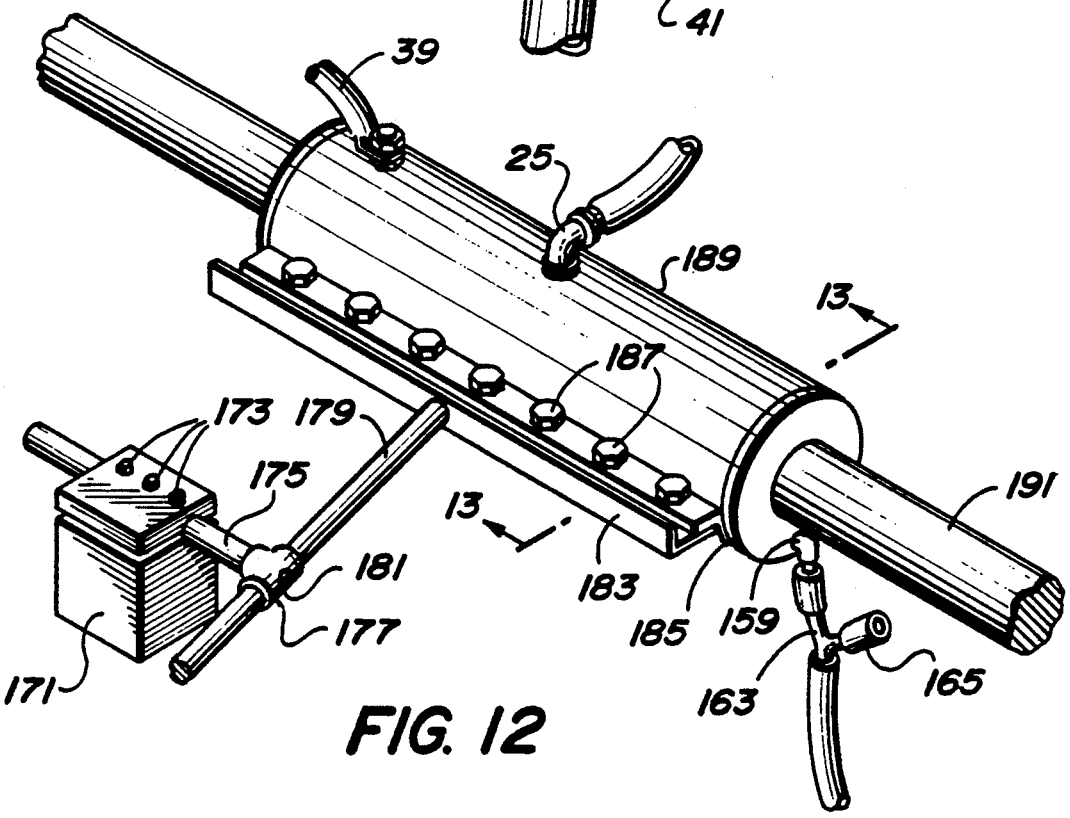
FIG. 12 is an isometric view of a holding or support arrangement for mounting of the apparatus of the invention on a shaft being repaired by brush plating.
Figure 13:
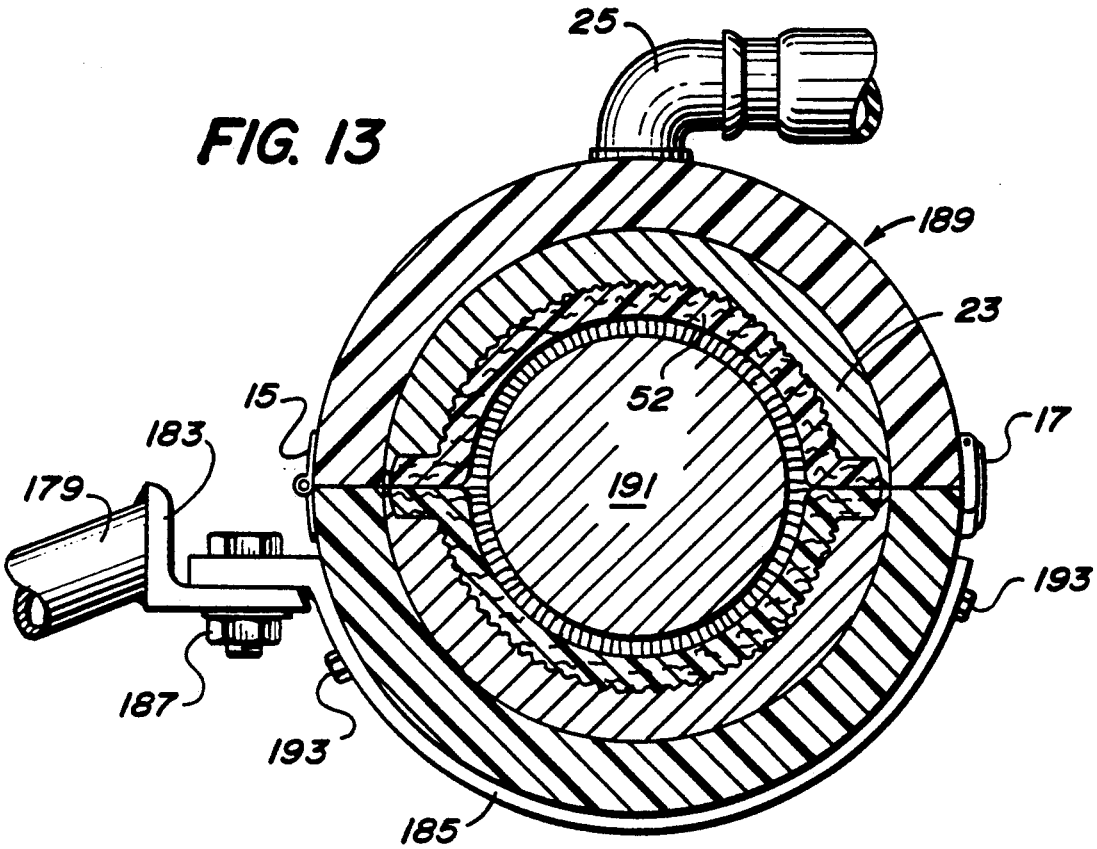
FIG. 13 is an enlarged end view of the clamp apparatus shown in FIG. 12 at the end of the clamp arm showing how the anode apparatus is mounted upon the clamp including a cross section through a coating apparatus in accordance with the invention.

FIGS. 12 and 13 illustrate diagrammatically a convenient and very practical arrangement for mounting an anode coating apparatus in accordance with the invention for coating a rotating shaft or the like. It is frequently convenient when brush coating a shaft or the like to rotate such shaft in a lathe apparatus or sometimes a grinding apparatus having appropriate capacity to mount and rotate the piece. All lathes are provided with a tool post for support of tools and the like during shaping of sections in or mounted on such lathes. Such tool post, therefore, provides a convenient support for the usual coating apparatus in accordance with the invention. In FIG. 12, there is shown a tool post 171 of a lathe, not shown. A series of heavy bolts or set screws 173 are arranged to bear against a rod or pipe such as a 2-inch pipe section 175 and hold such pipe section stationary with respect to the tool post. At the end of the clamped pipe 175 is a T-fitting 177 with the pipe 175 screwed into or otherwise attached to the center of said fitting 177 and an open bore across or through the top into which a second rod or pipe 179 may be slidingly inserted. A set screw 181 in the center of the T-fitting 177 may serve to stabilize the pipe 179 at any longitudinal position. On the end of the pipe or rod 179 there may be welded a support section in the form of a cross-piece 183 having a series of mounting holes or orifices which may be used to secure an anode support cradle 185 to the cross piece 183 either by means of threaded fastenings 187 or by means of other suitable fastenings. See FIG. 13 in particular. The anode chamber or assembly 189 is closed over a shaft 191 to be coated, which, as indicated, may be supported in an industrial lathe or the like. In such an arrangement, most of the weight of the anode assembly is actually supported by the lathe, or lathe chucks, not shown, through the work piece shaft, while the remainder of the weight of the anode assembly and holder is supported by the tool post through the mounting attachments. The weight of the anode chamber, furthermore, may be easily counterbalanced, if necessary, by a counterweight, not shown, provided on the opposite end of the supporting pipe or rod 179. The anode chamber 189 may be conveniently secured to the anode support cradle 185 by set screws 193.

Figure 14:
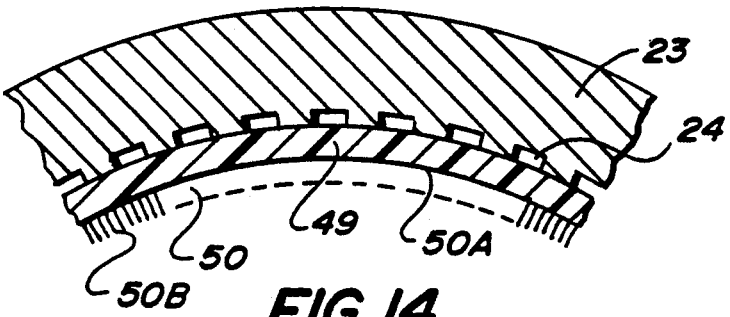
FIG. 14 is an enlarged sectional view through the absorbent plastic felt and brush arrangement of the anode wrap as it lies against a circumferential or arcuate anode surface.
Figure 15:
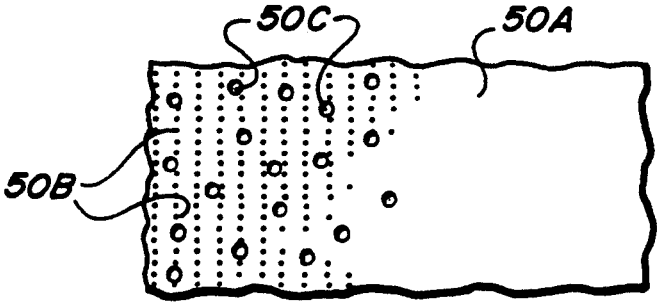
FIG. 15 is a bottom view of the anode wrap element shown in FIG. 14 showing the arrangement of the bristles of the brush element and the orifices in the bristle backing leading to the absorbent plastic felt.

FIG. 14 is a side or sectional view through an arcuate anode 23 showing more clearly the fluted or splined inner surface against which the anode wrap 52 is disposed. Such anode wrap is, as explained elsewhere, comprised of a first felted plastic material 49 and a second plastic brush element 50. This is shown in FIG. 14 as a brush element comprised of a perforated plastic backing 50A having bristles 50B extending away from it on the opposite side of the backing from the felted material. Flow orifices 50C shown more particularly in FIG. 15, extend through the backing 50A to provide openings for flow of electrolytic coating solution from the absorbent felt material 49 to the bristle area of the plastic brush 50. The bristles 50B preferably extend in rows somewhat closer together in one direction than the other. The perforations or flow orifices 50C, on the other hand, are usually more or less randomly spaced, although they can be regularly or evenly spaced in a pattern.

The essential equipment required for coating in accordance with the invention is as follows:

1. A custom made lead anode of the proper size and shape to completely cover the area of the work piece to be coated at all times. The anode is preferably approximately 7% tin and should be fluted or splined to provide an anode/cathode surface area ratio of approximately 1.5 to 1 or more as well as liquid channels for effective distribution of coating solution across the face of the anode and more or less uniformly into a plastic felt material. The anode must be pre-electrolyzed prior to beginning of coating.

2. A rectifier with less than 5% and preferably less than 1% ripple or ripple effect for the provision of the electrical potential between the anode and the cathodic work piece.

3. A heated filtered reservoir for electrolytic solution.

4. A chromic-acid resistant plastic, felt-type electrolytic solution absorbant or permeable material having on or associated with the surface thereof a chromic-acid resistant brush-type material having bristles or divided rubbing structures within an acceptable range of shape and size adequate to remove substantially all bubbles of gas continuously from the surface of the work piece during plating.

5. Chromic acid resistant fittings.

6. Electrolytic bath analysis equipment.

7. Means for providing continuous relative movement of the anode and work piece at close proximity to each other while retaining a section of the electrolyzed anode face at all times over, or immediately adjacent to, every portion of the area of the work piece to be hard chrome plated.

8. A pumping and reservoir arrangement to continuously supply fresh electrolytic solution to the face of the anode and remove it before it becomes significantly depleted of chromic plating material. The circulated plating solution will usually be removed from the coating area to the heated reservoir by gravity feed rather than pumping, but can also be pumped. The arrangement may include replenishment apparatus for making up or correcting for any depletion or other change in the bath analysis detected by the bath analysis equipment.

9. An acceptable environmental anti-pollution arrangement.

In the operation of the process of the invention, the anodes are, as explained above, first electrolyzed for two hours or so before use. The surface to be coated is carefully cleaned to remove any contamination or dirt. If such surface is stainless steel, nickel, chromium, copper or a combination of these, it should be either lightly blasted or chemically etched to produce a uniform matte finish. The area should then not be touched or soiled in any way until plating commences. In particular, any oxidation of the surface must be prevented. The part to be plated should be preheated to about 120 to 130 degrees Fahrenheit and the plating solution also heated to about 130° to 150° F. Such heating can be accomplished in several different ways, but one convenient and practical procedure is to initially flow hot water over the part or alternatively immerse the part in hot water. Various heating elements and the like can also be used. If there is heavy or old surface oxidation, sulfuric acid or other proprietary activators may be used to activate a nickel or nickel based substrate by stripping off all such heavy oxides. The anode is next positioned on the work piece and the monitoring voltmeter adjusted to approximately one volt. The solution pump can then be turned on and the anode moved in an orbital or figure eight manner at a speed of approximately 50 surface feet per minute (SFPM) or 10 surface inches per second (SIPS). A preferable rate is from about 8 to 12 surface inches per second. If the plastic anode wrap is already saturated with electrolytic solution before starting, it can be rested upon the work piece with a section of plastic sheeting between the anode and the work piece. The voltage is set as before, but as soon as the pump is turned on, the plastic sheet is quickly removed or stripped from between the anode wrap and the work piece before any solution is allowed to flow over the work piece without current. The current is then slowly raised to the operating current density of 2.5 to 3.5 amps. per square inch of anode contact area while carefully maintaining the anode/cathode movement. If the work piece, or cathode, is formed from carbon steel or is already chrome plated, the anode is preferably placed on, or actually adjacent to the area of the work piece to be coated and the coating solution flow started, but with the current off. The proper anode-to-cathode movement is started and maintained and the current is then turned on in a reversed mode, i.e. with the anode made cathodic, with one volt of potential for about 15 to 26 seconds, after which the current is applied in a forward mode at about three volts and then slowly raised as the amperage is increased to about 2.5 to 3.5 amps. per square inch current density, the voltage being maintained at about 8 to 10 volts during this entire period. The initial reverse plating serves to remove or dissolve a very thin layer of the surface coating not only to very effectively activate the surface for subsequent coating by removing any layer of oxide, but also to etch the surface for better coating adhesion. Such procedure is particularly effective when the new coating is being applied over an earlier coating so long as the earlier coating is not nickel or a nickel based alloy. The same procedure is followed for coating chrome on an original steel surface.

As indicated above, the electrolytic solution can be a conventional fluoride-type so-called mixed catalyst electrolytic plating solution for tank plating. Good chrome plating practices with respect to initial cleaning, the types of materials coated and the like are adhered to in all cases as the normal principles of chromizing in general continue to apply.

As the plating progresses and the chrome deposit approaches 0.004–0.005 inches in thickness, the surface may become rough, particularly over any thieving tape, so that it may become difficult to continue proper relative movement of the anode with respect to the cathode. At this point, it may be necessary to stop the operation, remove the masking and grind smooth any nodularity in the chrome, after which the plating operation can be begun again in the same mode as when originally plating chromium on chrome ab initio. For very heavy coatings, it may be possible to lay down as much as 0.008 inches of chrome or more before smoothing by grinding becomes necessary. For example, in providing a 0.02 coating, three 0.008 coatings may be deposited consecutively with grinding between each stage. Since nodularity and roughness inherently becomes greater as plating proceeds, a very thick buildup may become so rough as to effectively destroy the brush element if plating is continued too long and it is more effective with respect to materials and time to provide intermediate stages of grinding after each of which, of course, the coating process is restarted as from the beginning.

As indicated above, when plating chrome on nickel or nickel alloy, the surface should, after being degreased, first, be abraded with Scotchbrite cleaner, pumice and water to remove old oxides on the surface or treated with a proprietary nickel or chromium activator as the case may be and then with water. As indicated above, the lead anode is then attached or placed over the area to be chrome coated and the current turned on at 1 volt forward, after which the current is slowly raised to 2.5 to 3.5 amps. per square inch as the part is moved relative to the anode surface at preferably about 50 surface feet per minute, or 50 SFPM.

In all cases, the area to be coated on the work piece is outlined with a grounded lead thieving tape in the same manner as in regular brush plating, except that lead tape is used for thieving instead of an aluminum tape. Such thieving tape, in effect, reduces the current potential near the edge of the coated area and alleviates edge buildup of the coating around the edges of the coated area. Masking tape beyond this area blocks off or masks those portions of the surface which are not to be coated at all. The thieving tape around the edges of the area to be coated also does this, but in addition, steals or drains off current at the sides to reduce undesirable edge buildup of the coating. The thieving tape is normally covered itself up to about one-quarter inch from the side with masking tape. The final deposit of chrome can be ground to size. Such grinding is considered to be an effective test of both the adhesion and cohesion of the coating.

It may be necessary to clean the active anode surface periodically to remove deposits and maintain good conductivity. Such cleaning can be accomplished by means of wire brushing and the like. In general, all surfaces of the work piece which are not to be coated, but may be exposed to the electrolytic solution, must be protected from contact with the mixed catalyst bath by masking or the like or they will be severely attacked by such aggressive bath material.

Commercial equipment for continuously analyzing the bath composition and replenishing the bath or adjusting its composition to bring it back to a desired composition is available. Such bath analysis is necessarily conducted more frequently in most cases in a brush plating operation than in a plating tank bath because the brush plating solution volume is small.

The process and apparatus of the invention has been found very satisfactory for the plating of hard chromium of significant thicknesses such as four-to-six thousandths of an inch or more of hard chrome from hexavalent electrolytic chromium plating solutions. However, it can also be used to plate from a trivalent plating solution. Hard chrome coatings only a fraction as heavy, such as, for example, four-or-five ten thousandths of an inch, have only been available before from brush plating-type processes, except in those cases where the process is continuously restarted or initiated over long periods, an essentially impractical procedure. In most prior attempts to provide hard chrome coatings by brush plating, initial plating would begin fairly satisfactorily, but the plating rate rapidly declined to almost nothing in fairly short order, and could not be brought back to a reasonable operating rate, the reason for such difficulties not being known.

The detailed advantages of brush plating of hard chromium coatings as compared to tank plating are, in general, as follows:

1. Deposits can be made from about 1.5 to 3 times faster with brush plating than with tank plating.

2. Heavy thickness of the coating material can be plated to specifications.

3. Only small quantities of plating solutions are required for each plating rather than hundreds of gallons of plating solution.

4. Only minimal masking and "thieving" are necessary against the necessity of masking large areas in tank plating, where sometimes the entire piece or area must be immersed in order to plate only a small surface area.

5. The coating area can be completely closed off from the environment so there is less necessity for large and complicated fume hoods, duct work and the like to handle toxic mists and fumes.

6. Considerable increased capacity can be gained without a large outlay for equipment in an existing facility.

7. Large, delicate and expensive parts such as turbine assemblies, can be ground and plated frequently on the same piece of equipment with a possible minimization of time, potential damage and insurance costs.

8. Brush plating processes can frequently utilize existing brush plating equipment.

9. Brush plating can be used for precisely plating relatively small areas in fairly precise thicknesses.

It will be recognized from the foregoing description and explanation in connection with the appended drawings that the present invention provides a very effective and efficient method and apparatus for providing hard chromium coatings upon work pieces by means of a brush coating-type operation. While brush coating of soft chromium coatings has been achievable before, the attainment of hard chromium coatings of any significant thickness was previously unobtainable. As explained in more detail above, the Applicant has been able to obtain consistent and more than satisfactory hard chromium coatings upon work pieces by following the requirements of his process and apparatus which essentially requires the maintenance of a constant and uniform current density over all portions of the material to be coated while coating is taking place and in order to obtain this requirement, requires that the anode be always maintained above the portion of the material being coated. Furthermore, the Applicant has found that in order to obtain good hard chromium coatings, one must maintain a relatively constant and fairly rapid flow of electrolytic solution over the electrode surface during plating and that no portions of said solution can be allowed to become depleted of the chromium metal else the hard chromium coatings will cease deposition and/or become seriously defective. Applicant is able to obtain, therefore, hard chromium coatings, by a combination of factors precisely calculated to obtain hard chromium coatings including apparatus which maintains a lead or lead-tin anode always over and closely adjacent to the portion of the work piece which is to be coated, which maintains a constant current density within certain ranges between the anode and the cathodic work piece, which maintains a constant flow of plating solution at all times over the surface, which maintains a constant temperature within critical ranges and which also maintains a constant current density between the anode and the cathodic material at all times without any significant variation which might lead to the deposition of defective chromium coatings or no chromium coating at all rather than the desired hard chromium coatings. Chromic acid resistant felt-like solution absorbing material and brush materials are used in the process.

In the foregoing discussion and description as well as in the following claims the following terms should be understood to have the meanings assigned as follows:

(a) "Brush plating" or "selective plating" is an electrolytic plating operation involving the use of electroplating solutions applied to a restricted area of a work piece and held or maintained between the work piece surface and an adjacent anode by means of an absorbent or solution-holding material often having the characteristics of a felt-like material.

(b) "Brush material" refers to a material having the general characteristics of a brush in that it incorporates a plurality of individual or discontinuous rubbing or contact elements usually in the form of elongated bristles or the like for movable contact with a surface to effect such surface in some manner and particularly to facilitate removal or detachment of material including gases from such surface and which is in the present context effective to continuously remove or sweep bubbles of oxygen or other contaminants from such surface when immersed in a liquid. Such brush material should be sufficiently restricted in space between individual brushing elements or bristles and contact of such elements with the surface to be coated both to maintain a full volume of surrounding coating liquid and to effectively brush the entire surface of the adjacent material being brushed.

(c) "Chrome electroplating solution", "electrolytic coating solution" or "bath" refers to any proprietary or especially formulated chromium electroplating solution which can be effectively used for either tank plating or brush plating to provide an electro deposited chromium coating, such solution may contain either trivalent or hexavalent chromium compounds or complexes and may and usually does contain other compounds such as brightening agents, inhibiting agents and the like.

(d) "Soft chromium coating" or "soft chromium plating" refers to an electroplated chromium deposit which has a relatively low specific weight, is more or less porous and is relatively weak in compression and has a relatively low abrasion resistance.

(e) "Hard chromium coating" or "hard chromium plating" refers to an electroplated chromium metal deposit which has a relatively high specific weight, is dense and compacted rather than porous and is relatively strong in compression and has a relatively high abrasion resistance.

(f) "Vat or tank electroplating" or "vat or tank electrocoating" refers to the provision of electroplated coatings upon work pieces while such pieces are substantially immersed either completely, partially or effectively within a container of plating solution and includes the coating of a portion of a work piece which is specifically contacted with or partially immersed within a body of plating solution as contrasted with having a relatively restricted or limited quantity of electroplating solution applied in a relatively restricted volume or layer upon a portion of a work piece to be plated.

(g) "Absorbent material" or "absorbent felt-like material" or "felt-like material" means a material having the capacity to absorb or hold a quantity of liquid and to retain such liquid at least to a reasonable extent against the force of gravity and, in the present context, particularly a plastic resin material having the property of taking up or absorbing and retaining an electrolytic coating solution and effectively retaining such solution in such material sufficiently so that at least if such coating solution is continuously supplied to one side of such material a surface in contact with the other side of such material will be continuously bathed in the solution and in which the chemical composition and structure of the absorbent material is such that it is not significantly attacked by the electrolytic solution which is absorbed or held within it.

(h) "Effective anode contact" in the present context means having the anode of a brush plating apparatus adjacent to and at a relatively small distance from a cathodic work piece so that the anode is electrically coupled through any intervening electrolytic or electrically conducting liquid or medium with such adjacent work piece. Effective anode contact implies that the surface of the anode and the surface of the work piece in the area of such contact are substantially parallel. The interval between the work piece and the electrode surface may usually be taken up or established by an essentially dielectric separating material through which discrete current-conducting entities such as metallic ions may migrate under an electric potential.

(j) "Active surface" when applied to an anode refers to that surface which is electrically coupled with an adjacent surface or work piece or is intended to be the surface through which electrical coupling is effected.

(k) "Electrolyzed" and "electrolyzed lead base" composition means a lead based or lead tin base material preliminarily treated by an electrolysis treatment comprising passing an electric current through the electrode while subreeraed in the electrolyte that is to be used as an electrolytic coating bath to form a coating on the surface, such electrolyzation being effected prior to use as a coating electrode.

(l) "Effectively attached" means that two bodies or structures are secured in position adjacent to each other either by attachment means or entities joining the two or via other positioning and securing means that effectively secure the two structures into operative position closely adjacent to each other.

(m) "Movement in a continuous mode" means that the relative position of two oppositely charged electrodes is continuously changing, but retained within certain predetermined limits.

(n) "Anode wrap" means an "absorbent material" and "brush material" taken together with the absorbent material separated from the brush material by a backing having perforations for passage of electrolytic coating solution.

Several embodiments of the invention have been shown, but it will be understood that the invention may be also practiced with other embodiments. It will also be understood that the invention as described is a brush coating or selective coating apparatus and method and has successfully produced hard chromium coatings and will produce such hard chromium coatings if practiced in accordance with the instructions given, even though such hard chromium coatings have not been obtainable by brush coating before.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

I claim:

1. A method of selective plating of a hard chromium coating upon a conductive base material comprising:

(a) substantially completely encompassing a portion of the surface of a work piece to be coated with a lead base electrode, said base electrode having a porous polymeric material resistant to attack by chromic acid covering the electrode surface and a polymeric brush material covering the porous plastic material, (b) adjusting the distance between the polymeric brush surface and the surface of the work piece to be coated so the brush surface is in contact with said surface to be coated, (c) establishing an electrical circuit from a source of direct current between the work piece acting as a cathode and the lead base electrode acting as an anode, (d) establishing continuous movement between the anode and the adjacent polymeric material as a whole and the surface of the work piece to be coated while maintaining at least a portion of the anode surface adjacent at all times to each portion of the surface of the work piece to be coated, and (e) continuously supplying and withdrawing or removing electrolyte to and from the porous polymeric material at a rate sufficient to maintain fresh solution constantly available at all plating areas between the anode and the work piece.

2. A method in accordance with claim 1 additionally comprising maintaining the temperature of the electrolyte in the polymeric material against the surface of the work piece within a range of 130° F. and 150° F.

3. A method in accordance with claim 1 wherein the movement between the anode and the cathodic work piece is effected by rotating the work piece within the lead base electrode acting as an anode.

4. A method in accordance with claim 1 additionally comprising circulating the electrolyte in a continuous circuit between the supply and the porous polymeric material at a predetermined rate sufficiently rapid to prevent any substantial depletion of the concentration of chromium in the electrolyzed as plating of chromium proceeds.

5. A method in accordance with claim 1 wherein a current density of 2.5 to 3.5 amperes per square inch is maintained between the anode and cathodic work piece.

6. A method in accordance with claim 3 wherein the rate of movement between the anode and cathode is at least 50 surface feet per minute.

7. A method in accordance with claim 4 wherein all rates are maintained substantially constant after beginning of the chromizing action whereby the plating of hand chrome is not allowed to stop until the desired amount of coating has been effected.

8. A method in accordance with claim 2 additionally comprising initially electrolyzing the lead base anode surface.

* * * * *